US008550588B2

(12) United States Patent
Hatanaka et al.

(10) Patent No.: US 8,550,588 B2
(45) Date of Patent: Oct. 8, 2013

(54) PRINTING USING PLURALITY OF COLOR INK INCLUDING WHITE INK

(75) Inventors: Yuji Hatanaka, Shiojiri (JP); Yoshihiko Matsuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 133 days.

(21) Appl. No.: 12/875,066

(22) Filed: Sep. 2, 2010

(65) Prior Publication Data

US 2011/0057976 A1 Mar. 10, 2011

(30) Foreign Application Priority Data

Sep. 4, 2009 (JP) ..... 2009-204885
May 14, 2010 (JP) ..... 2010-111683

(51) Int. Cl.
*B41J 2/205* (2006.01)

(52) U.S. Cl.
USPC ..... 347/15

(58) Field of Classification Search
None
See application file for complete search history.

(56) References Cited

U.S. PATENT DOCUMENTS 6,902,249 B2 6/2005 Suzuki et al.
7,244,021 B2 7/2007 Arai
7,407,277 B2 8/2008 Yoneyama
7,562,957 B2 7/2009 Mills et al.
7,708,398 B2 5/2010 Niioka et al.
2004/0189772 A1* 9/2004 Arai ..... 347/102
2006/0158481 A1* 7/2006 Spevak et al. ..... 347/43
2009/0207458 A1* 8/2009 Doggett et al. ..... 358/3.29

FOREIGN PATENT DOCUMENTS

JP 2003-285427 A 10/2003
JP 2004-023771 A 1/2004
JP 2004-306591 A 11/2004
JP 2008-074063 A 4/2008
WO 2005/105452 A1 11/2005
WO 2006/087583 A1 8/2006
WO 2008-530619 A 8/2008

* cited by examiner

*Primary Examiner* — Geoffrey Mruk
*Assistant Examiner* — Bradley Thies
(74) *Attorney, Agent, or Firm* — Kilpatrick Townsend & Stockton LLP

(57) ABSTRACT

A printing apparatus executes printing on a transparent print medium using a plurality of color ink including white ink. The printing apparatus includes: a head having a first nozzle group ejecting the plurality of color ink to form a color image and a second nozzle group ejecting the white ink and at least one kind of ink other than the white ink to form a toning white image, which is an adjusted white image; and a controller controlling the head to form a first color image, a first toning white image, a second toning white image set independently from the first toning white image, and a second color image in this order on one surface of the print medium.

12 Claims, 22 Drawing Sheets

COLOR IMAGE DATA
Cdata1
(CMYK 32 bits/PIXEL)

WHITE IMAGE DATA
WIdata1
(W 8 bits/PIXEL)

COLOR IMAGE DATA
Cdata2
(CMYK 32 bits/PIXEL)

WHITE IMAGE DATA
WIdata2
(W 8 bits/PIXEL)

FIG. 14A

Lab-CMYK CONVERSION LUTw1

| L | a | b | VIRTUAL CMYK | | | |
|---|---|---|---|---|---|---|
| | | | C | M | Y | K |
| 95 | 0 | 0 | 0 | 0 | 0 | 0 |
| 94 | 5 | 0 | 0 | 5 | 0 | 0 |
| 94 | 0 | 5 | 0 | 0 | 5 | 0 |
| 94 | 0 | −5 | 3 | 0 | 0 | 0 |
| 94 | −5 | 0 | 3 | 0 | 0 | 0 |
| 93 | 10 | 0 | 0 | 10 | 0 | 0 |
| 93 | 5 | 5 | 0 | 5 | 5 | 0 |
| 93 | 5 | −5 | 3 | 5 | 0 | 0 |
| 93 | 0 | 10 | 0 | 0 | 10 | 0 |
| 93 | 0 | −10 | 6 | 0 | 0 | 0 |
| 93 | −5 | 5 | 3 | 0 | 5 | 0 |
| 93 | −5 | −5 | 6 | 0 | 0 | 0 |
| 93 | −10 | 0 | 6 | 0 | 0 | 0 |
| 93 | −10 | 0 | 6 | 0 | 0 | 0 |
| 92 | 10 | 5 | 0 | 10 | 5 | 0 |
| 92 | 10 | −5 | 3 | 10 | 0 | 0 |
| ⋮ | ⋮ | ⋮ | ⋮ | ⋮ | ⋮ | ⋮ |
| 87 | −10 | 5 | 6 | 0 | 5 | 2 |
| 87 | −10 | −5 | 9 | 0 | 0 | 2 |
| 87 | −10 | −5 | 9 | 0 | 0 | 2 |
| ⋮ | ⋮ | ⋮ | ⋮ | ⋮ | ⋮ | ⋮ |

FIG. 14B

CMYK AND T-INK COLOR CONVERSION LUTw2

| VIRTUAL CMYK, T | | | | | INK COLORS | | | | | | |
|---|---|---|---|---|---|---|---|---|---|---|---|
| C | M | Y | K | T | C | M | Y | K | Lc | Lm | W |
| 0 | 0 | 0 | 0 | 100 | 0 | 0 | 2 | 0 | 0 | 0 | 255 |
| 0 | 0 | 5 | 0 | 100 | 0 | 0 | 7 | 0 | 0 | 0 | 255 |
| 0 | 0 | 10 | 0 | 100 | 0 | 0 | 12 | 0 | 0 | 0 | 255 |
| 0 | 0 | 15 | 0 | 100 | 0 | 0 | 17 | 0 | 0 | 0 | 255 |
| 0 | 5 | 0 | 0 | 100 | 0 | 0 | 2 | 0 | 0 | 8 | 255 |
| 0 | 5 | 5 | 0 | 100 | 0 | 0 | 7 | 0 | 0 | 8 | 255 |
| 0 | 5 | 10 | 0 | 100 | 0 | 0 | 12 | 0 | 0 | 8 | 255 |
| 0 | 5 | 15 | 0 | 100 | 0 | 0 | 17 | 0 | 0 | 8 | 255 |
| 0 | 10 | 0 | 0 | 100 | 0 | 0 | 2 | 0 | 0 | 15 | 255 |
| 0 | 10 | 5 | 0 | 100 | 0 | 0 | 7 | 0 | 0 | 15 | 255 |
| 0 | 10 | 10 | 0 | 100 | 0 | 0 | 12 | 0 | 0 | 15 | 255 |
| 0 | 10 | 15 | 0 | 100 | 0 | 0 | 17 | 0 | 0 | 15 | 255 |
| 0 | 15 | 0 | 0 | 100 | 0 | 0 | 2 | 0 | 0 | 23 | 255 |
| 0 | 15 | 5 | 0 | 100 | 0 | 0 | 7 | 0 | 0 | 23 | 255 |
| 0 | 15 | 10 | 0 | 100 | 0 | 0 | 12 | 0 | 0 | 23 | 255 |
| 0 | 15 | 15 | 0 | 100 | 0 | 0 | 17 | 0 | 0 | 23 | 255 |
| ⋮ | ⋮ | ⋮ | ⋮ | ⋮ | ⋮ | ⋮ | ⋮ | ⋮ | ⋮ | ⋮ | ⋮ |
| 15 | 5 | 15 | 0 | 50 | 0 | 0 | 26 | 2.5 | 19 | 4 | 200 |
| 15 | 10 | 0 | 0 | 50 | 0 | 0 | 13 | 0 | 23 | 15 | 200 |
| 15 | 10 | 5 | 0 | 50 | 0 | 0 | 16 | 2.5 | 19 | 11 | 200 |
| ⋮ | ⋮ | ⋮ | ⋮ | ⋮ | ⋮ | ⋮ | ⋮ | ⋮ | ⋮ | ⋮ | ⋮ |

FIG. 16

CMYK-INK COLOR CONVERSION

LUTc

| CMYK | | | | INK COLORS | | | | | | |
|---|---|---|---|---|---|---|---|---|---|---|
| C | M | Y | K | C | M | Y | K | Lc | Lm | IW |
| 0 | 0 | 0 | 0 | 0 | 0 | 0 | 0 | 0 | 0 | 0 |
| 0 | 0 | 33 | 0 | 0 | 0 | 83 | 0 | 0 | 0 | 0 |
| 0 | 0 | 66 | 0 | 0 | 0 | 165 | 0 | 0 | 0 | 0 |
| 0 | 0 | 100 | 0 | 0 | 0 | 250 | 0 | 0 | 0 | 0 |
| 0 | 33 | 0 | 0 | 0 | 0 | 0 | 0 | 0 | 83 | 0 |
| 0 | 33 | 33 | 0 | 0 | 0 | 83 | 0 | 0 | 83 | 0 |
| 0 | 33 | 66 | 0 | 0 | 0 | 165 | 0 | 0 | 83 | 0 |
| 0 | 33 | 100 | 0 | 0 | 0 | 250 | 0 | 0 | 83 | 0 |
| 0 | 66 | 0 | 0 | 0 | 64 | 0 | 0 | 0 | 165 | 0 |
| 0 | 66 | 33 | 0 | 0 | 64 | 83 | 0 | 0 | 165 | 0 |
| 0 | 66 | 66 | 0 | 0 | 64 | 165 | 0 | 0 | 165 | 0 |
| 0 | 66 | 100 | 0 | 0 | 64 | 250 | 0 | 0 | 165 | 0 |
| 0 | 100 | 0 | 0 | 0 | 200 | 0 | 0 | 0 | 55 | 0 |
| 0 | 100 | 33 | 0 | 0 | 200 | 83 | 0 | 0 | 55 | 0 |
| 0 | 100 | 66 | 0 | 0 | 200 | 165 | 0 | 0 | 55 | 0 |
| 0 | 100 | 100 | 0 | 0 | 200 | 250 | 0 | 0 | 55 | 0 |
| ⋮ | ⋮ | ⋮ | ⋮ | ⋮ | ⋮ | ⋮ | ⋮ | ⋮ | ⋮ | ⋮ |
| 100 | 66 | 0 | 33 | 200 | 64 | 0 | 83 | 55 | 165 | 0 |
| 100 | 66 | 33 | 33 | 200 | 64 | 83 | 83 | 55 | 165 | 0 |
| 100 | 66 | 66 | 33 | 200 | 64 | 165 | 83 | 55 | 165 | 0 |
| ⋮ | ⋮ | ⋮ | ⋮ | ⋮ | ⋮ | ⋮ | ⋮ | ⋮ | ⋮ | ⋮ |

FIG. 19

ICT

| | | INK COLORS | | | | | | |
|---|---|---|---|---|---|---|---|---|
| | | CYAN | MAGENTA | YELLOW | BLACK | LIGHT CYAN | LIGHT MAGENTA | WHITE |
| COLOR IMAGE | INK ABBREVIATION NAME | C | M | Y | K | Lc | Lm | IW |
| | INK CODE | 01H | 02H | 04H | 00H | 11H | 12H | 40H |
| TONING WHITE IMAGE | INK ABBREVIATION NAME | WC | WM | WY | WK | WLc | WLm | W |
| | INK CODE | 81H | 82H | 84H | 80H | 91H | 92H | C0H |

UPON W-C PRINTING

UPON C-W PRINTING

PRINTING USING PLURALITY OF COLOR INK INCLUDING WHITE INK

Priority is claimed under U.S.C §119 to Japanese Application No. 2009-204885 filed on Sep. 4, 2009, and Japanese Application No. 2010-111683 filed on May 14, 2010, which are hereby incorporated by reference in its entirety.

BACKGROUND

1. Technical Field

The present invention relates to a technique for executing printing using a plurality of color ink including white ink.

2. Related Art

There is known a printing apparatus (for example, see JP-A-2003-285427) capable of executing printing using white ink in addition to color ink such as cyan ink, magenta ink, yellow ink. The printing apparatus executing printing using a plurality of color ink including white ink is able to execute a backing process on a print medium with the white ink in order to reproduce a color image on a transparent film as a print medium, for example.

In general, although both are called "white ink", the color of white ink used in a printing apparatus executing gravure printing or flexographic printing may be different from the color of white ink used in a printer such as an ink jet printer. For example, there may be differences within the white ink used in ink jet printers according to the kind of printer. Therefore, in the past, when an image having a color part and a white part is printed using a plurality of color ink including white ink, it was not easy to reproduce the color of the white part to a desired color.

When a color image and a white image are printed using a plurality of color ink including white ink, it is desirable to obtain a print expressed with more diverse colors in some cases.

The above problem may arise not only in an ink jet printer, but may also arise when a color image and a white image are printed using a plurality of color ink including white ink.

SUMMARY

An advantage of some aspects of the invention is that it provides a technique for reproducing the color of a white image using a desired color and obtaining a print expressed with more diverse colors, when a color image and a white image are printed using a plurality of color ink including white ink.

The following aspects or applications according to the invention can be realized.

Application 1

According to an aspect of the invention, there is provided a printing apparatus which executes printing on a transparent print medium using a plurality of color ink including white ink. The printing apparatus includes: a head having a first nozzle group ejecting the plurality of color ink to form a color image and a second nozzle group ejecting the white ink and at least one kind of ink other than the white ink to form a toning white image, which is an adjusted white image; and a controller controlling the head to form a first color image, a first toning white image, a second toning white image set independently from the first toning white image, and a second color image in this order on one surface of the print medium.

In the printing apparatus, the head including the first nozzle group forming the color image and the second nozzle group forming the toning white image is controlled to form the images. The first color image, the first toning white image, and the second toning white image, and the second color image are formed in this order on the one surface of the print medium. The color of the second toning white image is set to be independent from the color of the first toning white image. Accordingly, when the printing is executed to print the color image and the white image using the plurality of color ink including the white ink, the color of the white image can be printed with a desired color. Moreover, a print can be expressed with diverse colors.

Application 2

In the printing apparatus according to Application 1, the controller may set a color of the first toning white image on the basis of the first color image and sets a color of the second toning white image on the basis of the second color image.

In the printing apparatus with this configuration, it is possible to highlight the color image or increase the contrast ratio of the color image, for example. Therefore, it is possible to easily set the color of the toning white image to match with the characteristics of the color image.

Application 3

The printing apparatus according to Application 1 or 2 may further include a rewind mechanism rewinding the print medium on which an image is formed. The controller may control the rewind mechanism to rewind the print medium after the first color image and the first toning white image are formed on the print medium and controls the head to form the second toning white image and the second color image on the rewound print medium.

In the printing apparatus with this configuration, a simple control can be easily realized to form the first color image, the first toning white image, the second toning white image, and the second color image in this order on the one surface of the print medium.

Application 4

In the printing apparatus according to Application 3, a positional relation of the first and second nozzle groups may be reverse between when the head forms the first color image and the first toning white image on the print medium and when the head forms the second color image and the second toning white image on the print medium. The controller may control the head so as to concurrently form the first color image by the first nozzle group and form the first toning white image by the second nozzle group for at least a part of a printing period and so as to concurrently form the second toning white image by the second nozzle group and the second color image by the first nozzle group for at least another part of the printing period.

In the printing apparatus with this configuration, the first color image and the first toning white image can be concurrently formed and the second color image and the second toning white image can be concurrently formed. Therefore, it is possible to effectively form the first color image, the first toning white image, the second toning white image, and the second color image on the one surface of the print medium.

Application 5

In the printing apparatus according to Application 1 or 2, each of the first and second nozzle groups of the head may include two sub-nozzle groups. The controller may control the head so as to concurrently form the first color image by one of the sub-nozzle groups of the first nozzle group, form the first toning white image by one of the sub-nozzle groups of the second nozzle group, form the second toning white image by the other of the sub-nozzle groups of the second nozzle group, and form the second color image by the other of the sub-nozzle groups of the first nozzle group for at least a part of a printing period.

In the printing apparatus with this configuration, it is possible to effectively form the first color image, the first toning white image, the second toning white image, and the second color image in this order on the one surface of the print medium.

Application 6

In the printing apparatus according to any one of Applications 1 to 5, the controller may form the first toning white image and the second toning white image in the same area of the surface of the print medium.

In the printing apparatus with this configuration, it is possible to generate a print in which only the first toning white image as a white image is viewed from one side and only the second toning white image as a white image is viewed from the other side.

Application 7

In the printing apparatus according to any one of Applications 1 to 6, the plurality of color ink may include a combination of light color ink and dark color ink for at least one color ink. The second nozzle group may not eject the dark color ink.

In the printing apparatus with this configuration, the color of the toning white image can be formed with a desired color. Moreover, the image quality of the toning white image can be prevented from deteriorating (increasing in granularity)

The invention may be realized in various forms. For example, the invention may be realized as the forms of a printing method, a printing apparatus, a printing control method, a printing control apparatus, a printing system, a computer program realizing the functions of the printing method, apparatus, and system, a recording medium recording the computer program, a computer data signal embedded in a carrier wave.

BRIEF DESCRIPTION OF THE DRAWINGS

The invention will be described with reference to the accompanying drawings, wherein like numbers reference like elements.

FIGS. 14A and 14B are explanatory diagrams partially illustrating examples of toning white image lookup tables.

FIG. 16 is an explanatory diagram partially illustrating an example of a lookup table for the color image.

FIG. 19 is an explanatory diagram illustrating an example of the details of an ink code table.

DESCRIPTION OF EXEMPLARY EMBODIMENTS

Hereinafter, an embodiment of the invention will be described in the following order.

A. Embodiment

A-1. Configuration of Printing System

A-2. Printing

B. Modified Examples

A. Embodiment

A-1. Configuration of Printing System

Figure 1:
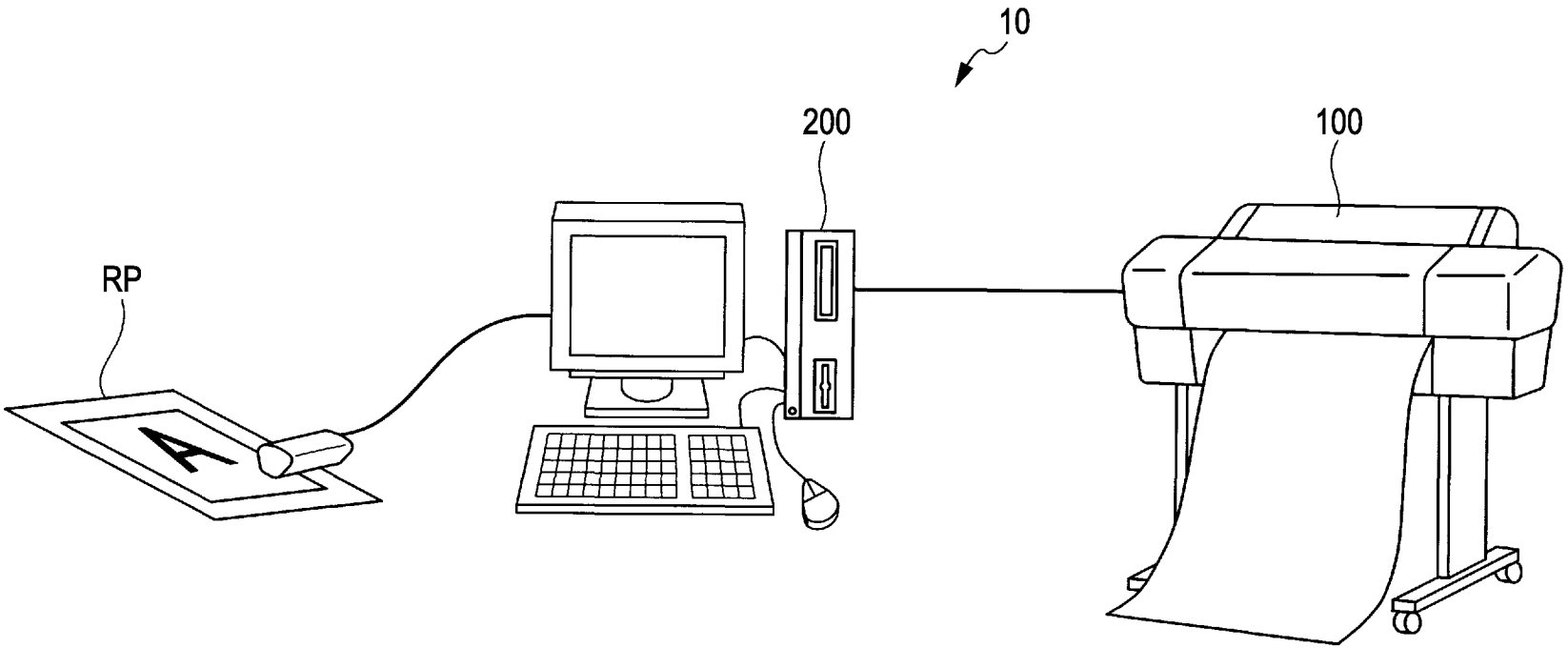
FIG. 1 is an explanatory diagram schematically illustrating the configuration of a printing system according to an embodiment of the invention.

FIG. 1 is an explanatory diagram schematically illustrating the configuration of a printing system according to an embodiment of the invention. A printing system 10 according to this embodiment includes a printer 100 and a personal computer (PC) 200. The printer 100 is an ink jet color printer that prints an image by ejecting ink to form ink dots on a print medium (for example, a transparent film). The PC 200 supplies print data to the printer 100 and functions as a print control apparatus that controls printing of the printer 100. The printer 100 and the PC 200 are connected to each other to enable information communication in a wired or a wireless manner. Specifically, the printer 100 and the PC 200 are connected to each other by a USB cable in this embodiment. In FIG. 1, an actual print (hereinafter, also referred to as a "real print RP") produced by a gravure printing apparatus, for example, is shown.

The printer 100 according to this embodiment is a printer that executes printing using a total of seven kinds of ink, that is, cyan (C) ink, magenta (M) ink, yellow (Y) ink, black (K) ink, light cyan (Lc) ink, light magenta (Lm) ink, and white (W) ink. As described below, the printing system 10 according to this embodiment executes printing by forming two color images and two toning white images on a transparent film as a print medium to make a print (hereinafter, also referred to as a "both-side print") on which a color image can be viewed from both sides of the print medium.

In the specification, a "white color" includes not only a white color which is a surface color of an object reflecting all wavelengths of the visible light by 100% precisely, but also a color, such as a "white-looking white color", which is a normally accepted white color. The "white color" is not limited to pure white, as long as (1) a color of a hue range in which the expression in the Lab system falls within a circle with the radius of 20 on the a*b* plane and L* is equal to or more than 70 when the color measurement apparatus Eye-one Pro made by X-Rite corporation measures a color under the condition that a color measurement mode is a spot color measurement, a light source is D50, backing is black, and a print medium is a transparent film; (2) a color of a hue range in which the expression in the Lab system falls within a circle with the radius 20 on the a*b* plane and L* is equal to or more than 70 when the color measurement apparatus CM 2022 made by Minolta corporation measures a color under the condition that a color measurement mode is D502° view and an SCF mode and a backing color is white; and (3) the color of ink used as the backing of an image as disclosed in JP-A-2004-306591 is used as the color of the backing In the specification, adjusting a white color by mixing another color ink with white color ink is called "white color toning". In addition, a white color (adjusted white color) produced by the white color toning is called "toning white color" and an image organized by the toning white color is called a "toning white image".

Figure 2:
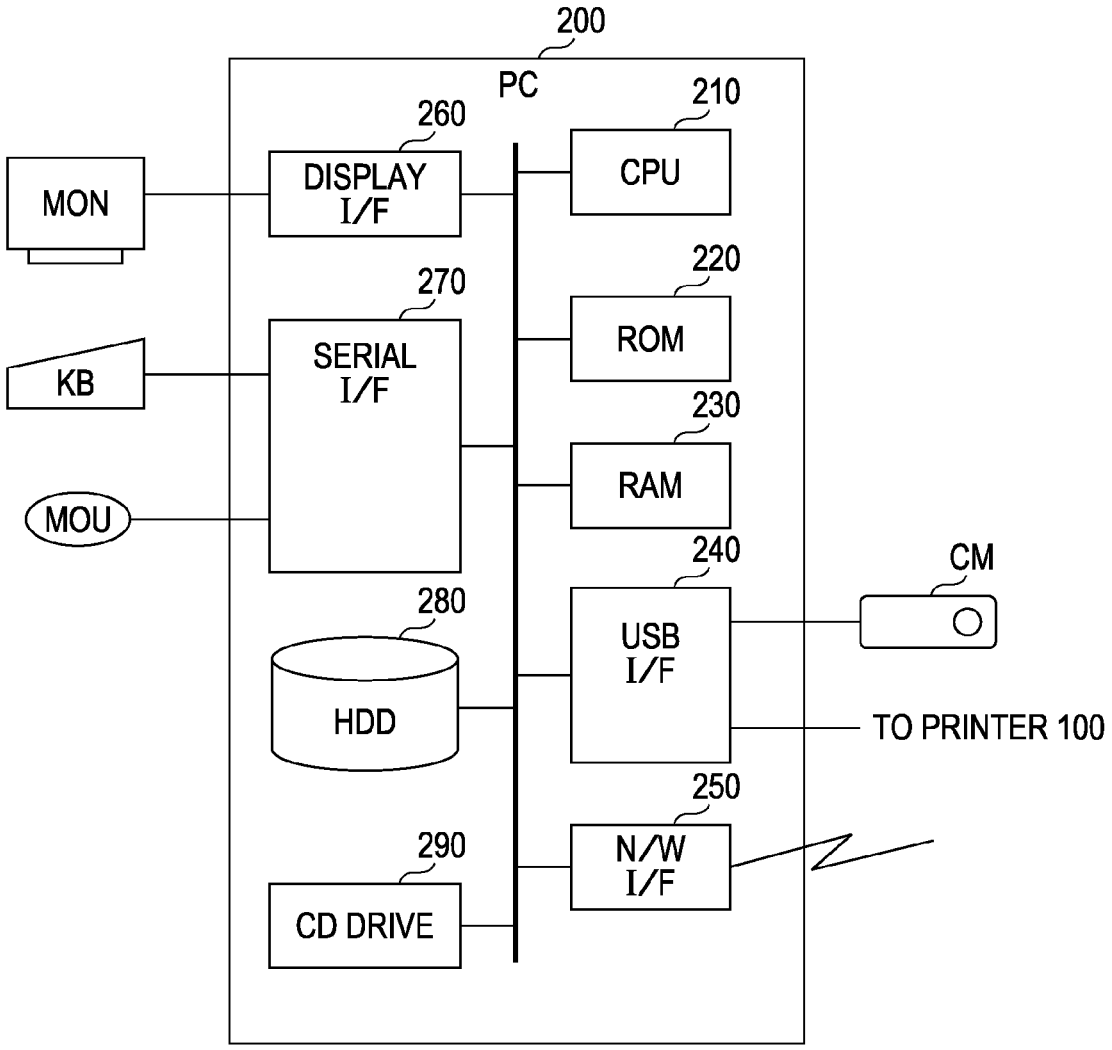
FIG. 2 is an explanatory diagram schematically illustrating the configuration of a PC.

FIG. 2 is an explanatory diagram schematically illustrating the configuration of the PC 200. The PC 200 includes a CPU 210, a ROM 220, a RAM 230, a USB interface (USB I/F) 240, a network interface (N/W I/F) 250, a display interface (display I/F) 260, a serial interface (serial I/F) 270, a hard disk drive (HDD) 280, and a CD drive 290. The constituent elements of the PC 200 are connected to each other via a bus.

The PC 200 is connected to the printer 100 via the USB interface 240. A USB interface of a color measurement machine CM is connected to the USB interface 240 of the PC 200. A monitor MON serving as a display device is connected to the display interface 260. A keyboard KB and a mouse MOU serving as input devices are connected to the serial interface 270. The configuration of the PC 200 illustrated in FIG. 2 is just an example. Some of the constituent elements of the PC 200 may be omitted or a new constituent element may be added to the PC 200.

Figure 3:
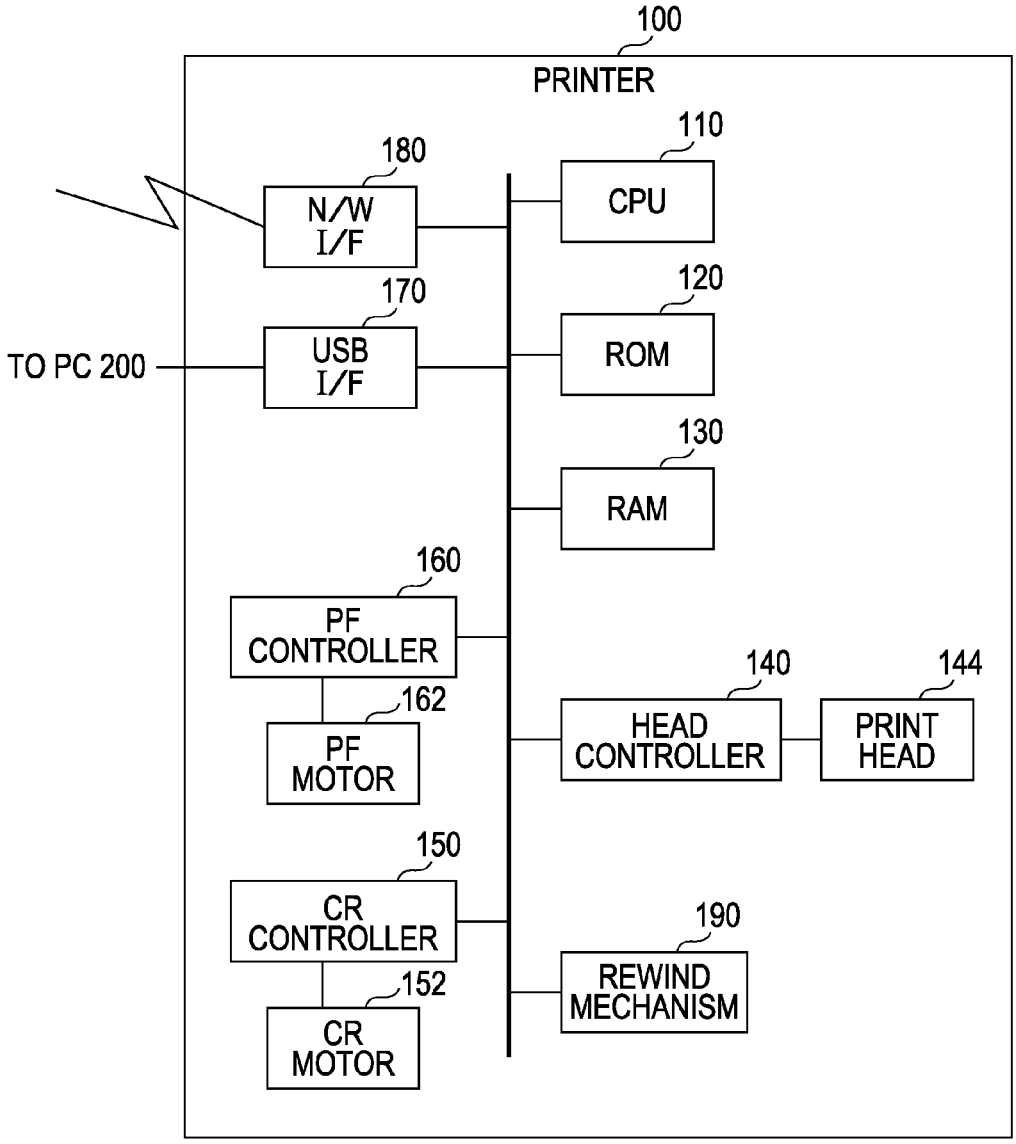
FIG. 3 is an explanatory diagram schematically illustrating the configuration of a printer.

FIG. 3 is an explanatory diagram schematically illustrating the configuration of the printer 100. The printer 100 includes a CPU 110, a ROM 120, a RAM 130, a head controller 140, a print head 144, a carriage controller (CR controller) 150, a carriage motor (CR motor) 152, a print medium feeding controller (PF controller) 160, a print medium feeding motor (PF motor) 162, a USB interface (USB I/F) 170, a network interface (N/W I/F) 180, and a rewind mechanism 190. The constituent elements of the printer 100 are connected to each other via a bus.

The CPU 110 of the printer 100 serves as a controller that performs overall control of the operation of the printer 100 by executing a computer program stored in the ROM 120. The print head 144 of the printer 100 is mounted on a carriage (not shown). The carriage controller 150 controls the carriage motor 152 to reciprocate the carriage in predetermined directions. In this way, a main scanning operation is realized in such a manner that the print head 144 reciprocates in a predetermined direction (main scanning direction) of the print medium. The print medium feeding controller 160 controls the print medium feeding motor 162 to execute a sub-scanning operation of transporting the print medium in a direction (sub-scanning direction) perpendicular to the main scanning direction. The print head 144 has a nozzle group (see FIGS. 22A to 22C) ejecting ink. The head controller 140 controls ink ejection from the nozzle group by the print head 144 in interlock with the main scanning operation and the sub-scanning operation. In this way, an image is formed on the print medium (printing of an image). The rewind mechanism 190 is a mechanism that rewinds the print medium to form a new image on the print medium on which an image is formed. Since the configuration of the rewind mechanism 190 is disclosed in JP-A-2008-74063, the detailed description is omitted herein.

Figure 4:
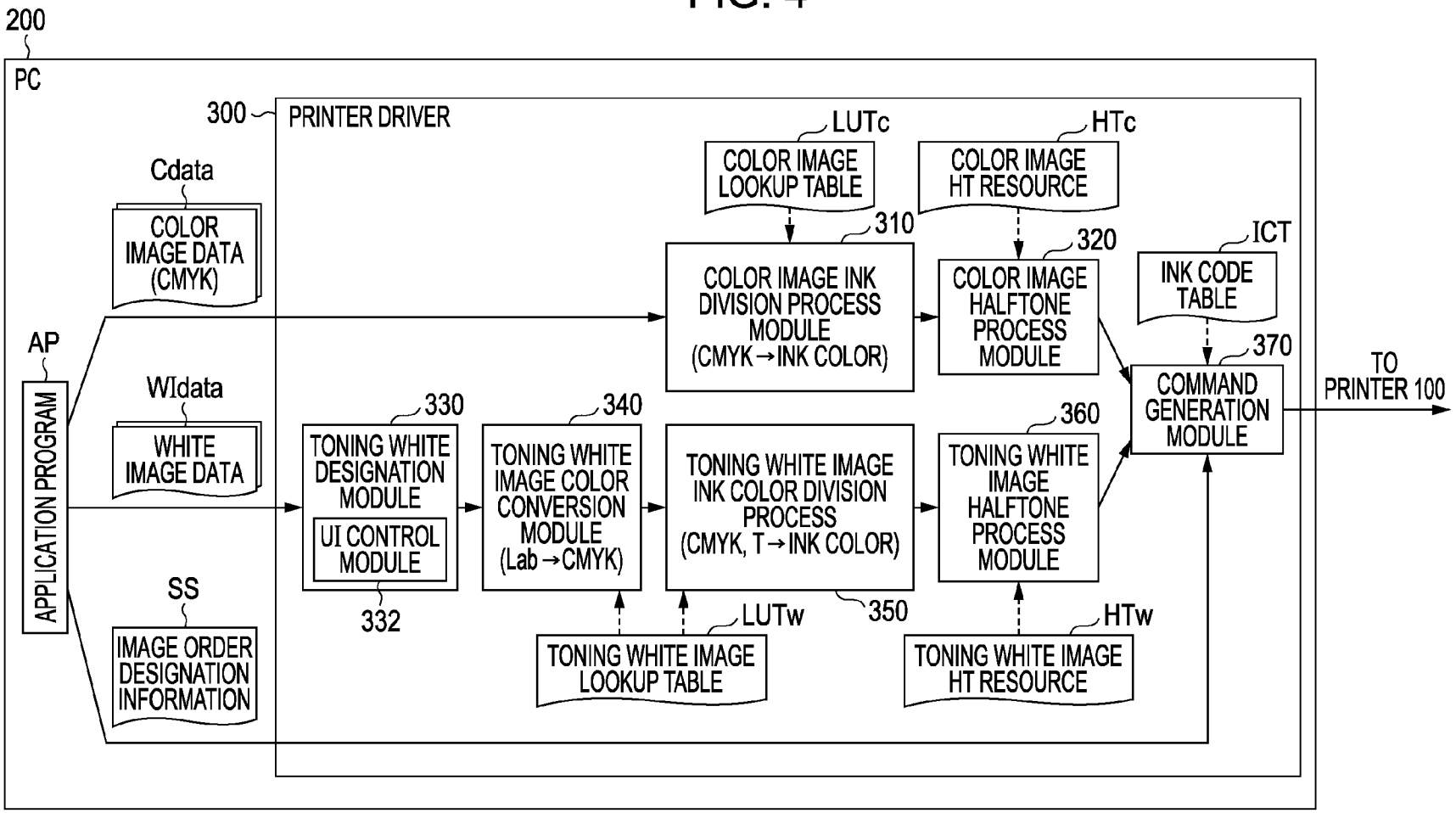
FIG. 4 is a block diagram illustrating the functional configuration of the PC.

FIG. 4 is a block diagram illustrating the functional configuration of the PC 200. The hard disk drive 280 (see FIG. 2) of the PC 200 stores an application program AP as a computer program to be executed by the CPU 210 and a printer driver 300. The application program AP is a program used to set, create, and edit an image (hereinafter, also referred to as a "print image") to be printed on a transparent film as a print medium. The CPU 210 executes the application program AP to set, create, and edit the print image.

When a user gives a print execution instruction, the CPU 210 executing the application program AP outputs color image data Cdata, white image data WIdata, and image order designation information SS to the printer driver 300. More specifically, first color image data Cdata1 and second color image data Cdata2 used to form first and second color images, respectively, and first white image data WIdata1 and second white image data WIdata2 used to form first and second toning white images, respectively, are output from the application program AP to the printer driver 300. The details of the data are described in "A-2. Printing".

The printer driver 300 (see FIG. 4) is a program used to control the printer 100 (see FIG. 1) and print the print image. The CPU 210 (see FIG. 2) executes the printer driver 300 to realize print control of an image printed by the printer 100.

As shown in FIG. 4, the printer driver 300 includes a color image ink division process module 310, a color image halftone process module 320, a toning white designation module 330, a toning white image color conversion module 340, a toning white image ink color division process 350, a toning white image halftone process module 360, and a command generation module 370. The toning white designation module 330 includes a UI control module 332. The hard disk drive 280 (see FIG. 2) of the PC 200 stores a color image lookup table (LUT) LUTc, a color image halftone (HT) resource HTc, a toning white image lookup table (LUT) LUTw, a toning white image halftone (HT) resource HTw, and an ink code table ICT. The printer driver 300 and the modules execute processes on the basis of the information. The functions of the modules and the details of the information are described in "A-2. Printing".

Figure 5:
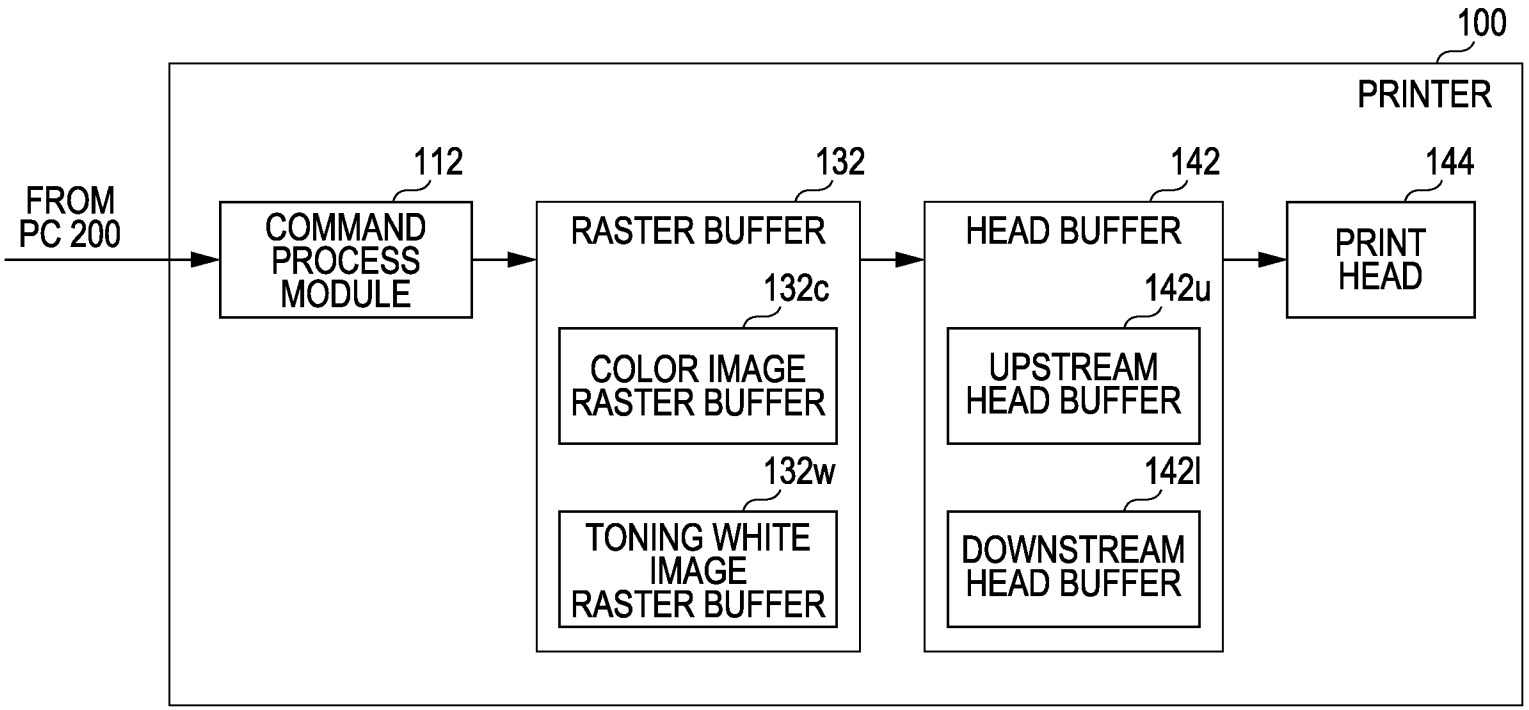
FIG. 5 is a block diagram illustrating the functional configuration of the printer.

FIG. 5 is a block diagram illustrating the functional configuration of the printer 100. The ROM 120 (see FIG. 3) of the printer 100 stores a command process module 112 as a computer program to be executed by the CPU 110. As described below, the CPU 110 executes the command process module 112 to realize a command process received from the PC 200. The RAM 130 (see FIG. 3) of the printer 100 includes a raster buffer 132. The raster buffer 132 includes two areas of a color image raster buffer 132*c* and a toning white image raster buffer 132*w*. The head controller 140 (see FIG. 3) of the printer 100 includes a head buffer 142. The head buffer 142 includes an upstream head buffer 142*u* and a downstream head buffer 1421. The function and the detailed configuration of the program and the buffer are described in "A-2. Printing".

A-2. Printing

Figure 6:
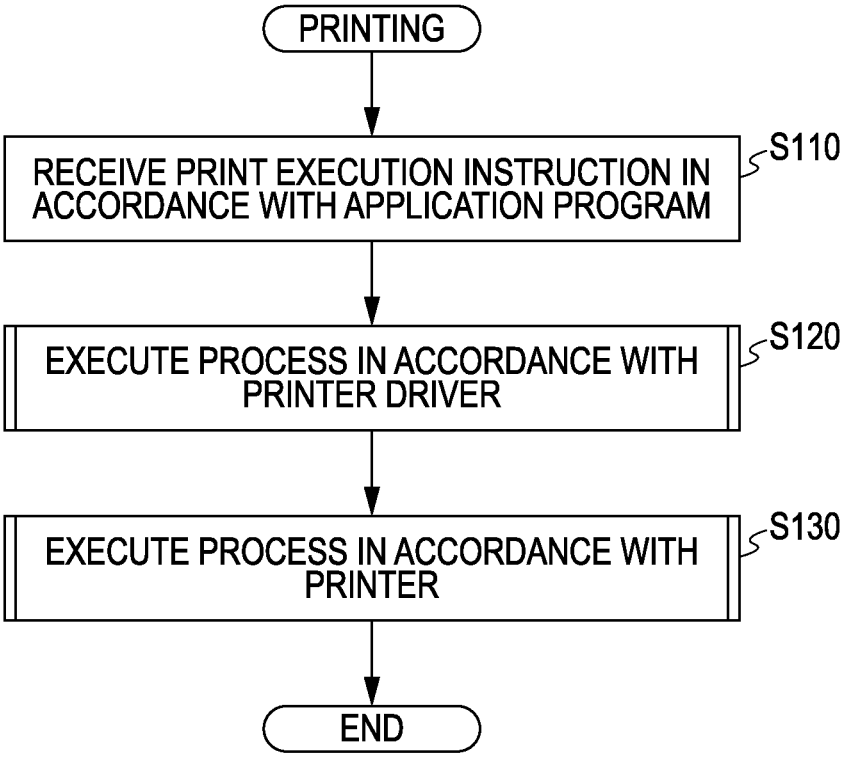
FIG. 6 is a flowchart illustrating a printing routine of printing in the printing system according to the embodiment of the invention.

FIG. 6 is a flowchart illustrating a printing routine of the printing system 10 according to this embodiment. The printing according to this embodiment is a process of forming two color images and two toning white images on a transparent film as a print medium and creating a double-side print Pr on which color images can be viewed from the front and rear sides of the print medium.

Figure 7A:
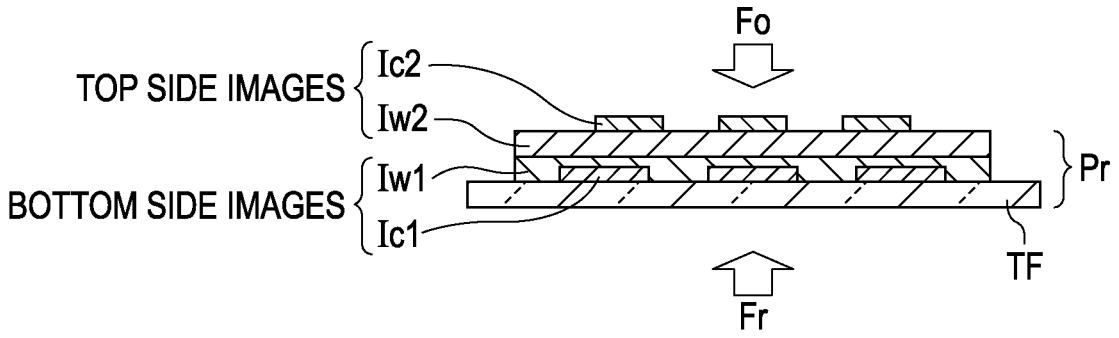
FIGS. 7A and 7B are explanatory diagrams illustrating an example of a double-side print produced by printing according to the embodiment of the invention.
Figure 7B:
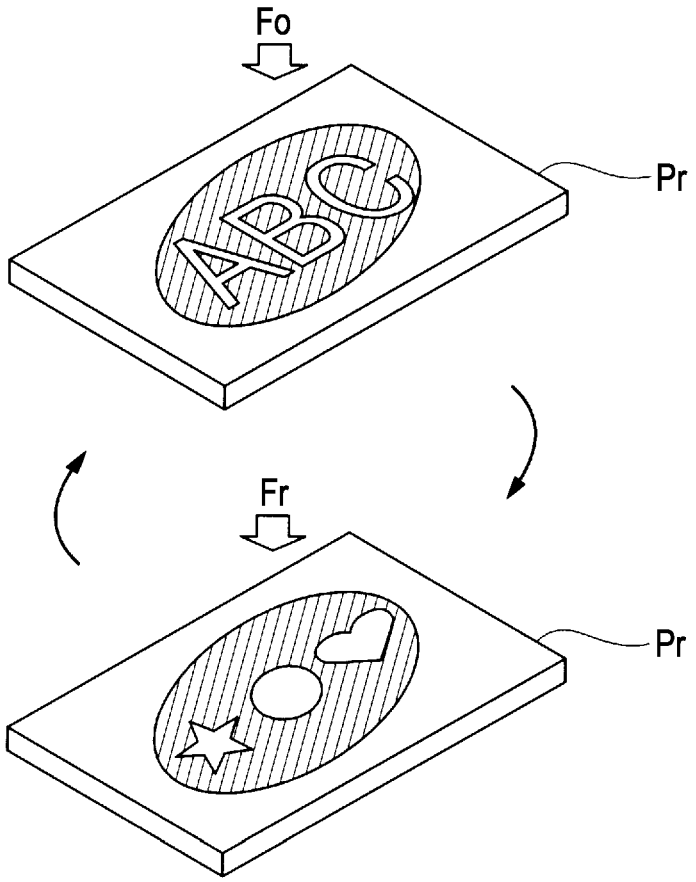

FIGS. 7A and 7B are explanatory diagrams illustrating an example of the double-side print Pr created by the printing according to this embodiment. As shown in FIG. 7A, the double-side print Pr is a print created by forming a first color image Ic1, a first toning white image Iw1, a second toning white image Iw2, and a second color image Ic2 in this order on one surface of a transparent film TF as a print medium. In the double-side print Pr, as shown in FIGS. 7A and 7B, the second color image Ic2 and the second toning white image Iw2 are viewed from the one surface (hereinafter, also referred to as an "obverse side Fo") of the transparent film TF, and the first color image Ic1 and the first toning white image Iw1 are viewed from the opposite surface (hereinafter, also referred to as a "reverse side Fr") of the transparent film TF. That is, the double-side print Pr can be used as a print viewed from both sides of the obverse side Fo and the reverse side Fr.

In this embodiment, the two toning white images Iw (the first toning white image Iw1 and the second toning white image Iw2) are formed in the same area on the front side of the transparent film TF. Moreover, the area where the two toning white images Iw are formed is an area including an area where the two color images Ic (the first color image Ic1 and the second color image Ic2) are formed. Therefore, only the second color image Ic2 and the second toning white image Iw2 are viewed from the obverse side Fo and only the first color image Ic1 and the first toning white image Iw1 are viewed from the reverse side Fr.

In the following description, the second color image Ic2 and the second toning white image Iw2 viewed from the obverse side Fo are together referred to as "obverse side images". The first color image Ic1 and the first toning white image Iw1 viewed from the reverse side Fr are together referred to as "reverse side images". A person viewing the double-side print Pr views the reverse side images through the transparent film TF (over the transparent film TF) and views the obverse side images directly (without the transparent film TF).

In the printing according to this embodiment, as described below, the reverse side images are first formed, the print medium is rewound, and then the obverse side images are formed. When the reverse side images are formed, the first color image Ic1 is formed and then the first toning white image Iw1 is formed in one area of the print medium. In this embodiment, the printing order in which the color image is formed and then the toning white image is formed is referred to as "color-white printing" or "C-W printing". On the other hand, when the obverse side images are formed, the second toning white image Iw2 is formed and then the second color image Ic2 is formed in one area of the print medium. In this embodiment, the printing order in which the toning white image is formed, and then the color image is formed is referred to as "white-color printing" or "W-C printing".

In step S110 of the printing (see FIG. 6), the CPU 210 (see FIG. 2) executing the application program AP (see FIG. 4) receives a print execution instruction from a user. When receiving the print execution instruction, the CPU 210 outputs the two color image data Cdata and the two white image data WIdata, and the image order designation information SS to the printer driver 300 (see FIG. 4). The color image data Cdata is data for designating a color image in a print image. The white image data WIdata is data for designating a white area Aw (which is described below) in a print image. The image order designation information SS is information for designating an order, in which images are formed on the basis of the image data, for the respective image data. That is, the image order designation information SS is information for designating whether the respective image is data used to form the reverse side images (see FIGS. 7A and 7B) or data used to form the obverse side image. The color image data Cdata, the white image data WIdata, the image order designation information SS are created and set in accordance with the application program AP.

Figure 8A:
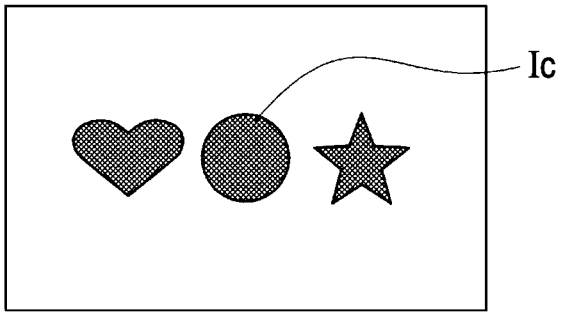
FIGS. 8A to 8D are explanatory diagrams illustrating examples of color image data and white image data.
Figure 8B:
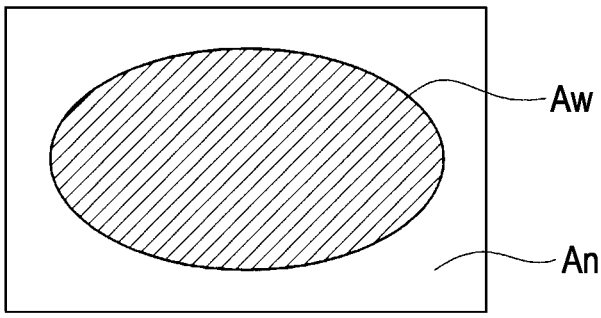
Figure 8C:
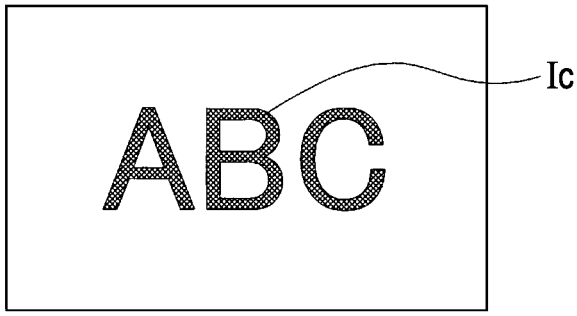

FIGS. 8A to 8D are explanatory diagrams illustrating examples of the color image data Cdata and the white image data WIdata. FIG. 8A conceptually shows the first color image data Cdata1 used to form the first color image Ic1 (see FIGS. 7A and 7B). FIG. 8C conceptually shows the second color image data Cdata2 used to form the second color image Ic2. In this embodiment, the respective color image data Cdata are data for designating the color of pixels of the print image to 8-bit C, M, Y, and K values when only an area used to form the color image IC is emphasized. The respective color data Cdata are data for designating the color of the color image Ic for the pixels corresponding to the color image Ic and are data (for example, C, M, Y, and K=0) for indicating that no color image is formed for the remaining pixels. In the examples of FIGS. 8A to 8D, the color image Ic is a character or a figure. However, the color image Ic may be a photo or an illustration.

Figure 8D:
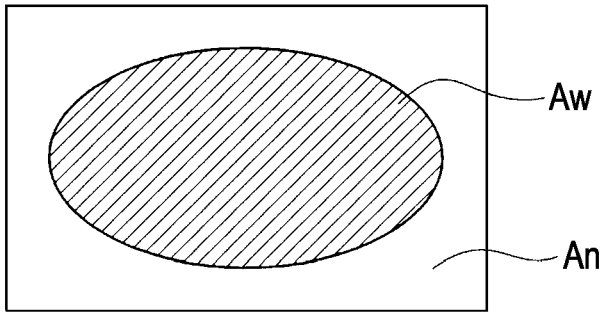

FIG. 8B conceptually shows the first white image data WIdata1 used to the first toning white image Iw1 (see FIGS. 7A and 7B). FIG. 8D conceptually shows the second white image data WIdata2 used to form the second toning white image Iw2. In this embodiment, the respective white image data WIdata are data designating the color of each pixel of the print image as an 8-bit W value when the color image IC is excluded. The range of the W value is one from 0 to 255. The respective white image data WIdata becomes data (for example, W=255) indicating that the toning white image Iw is formed for the pixels corresponding to the white area Aw (which is an area where the toning white image Iw is formed) of the print image and becomes data (for example, W=0) indicating that no toning white image Iw is formed for the pixels corresponding to a non-white area An (where is an area where no toning white image Iw is formed). The white image data WIdata may be 2-bit data.

Figure 9:
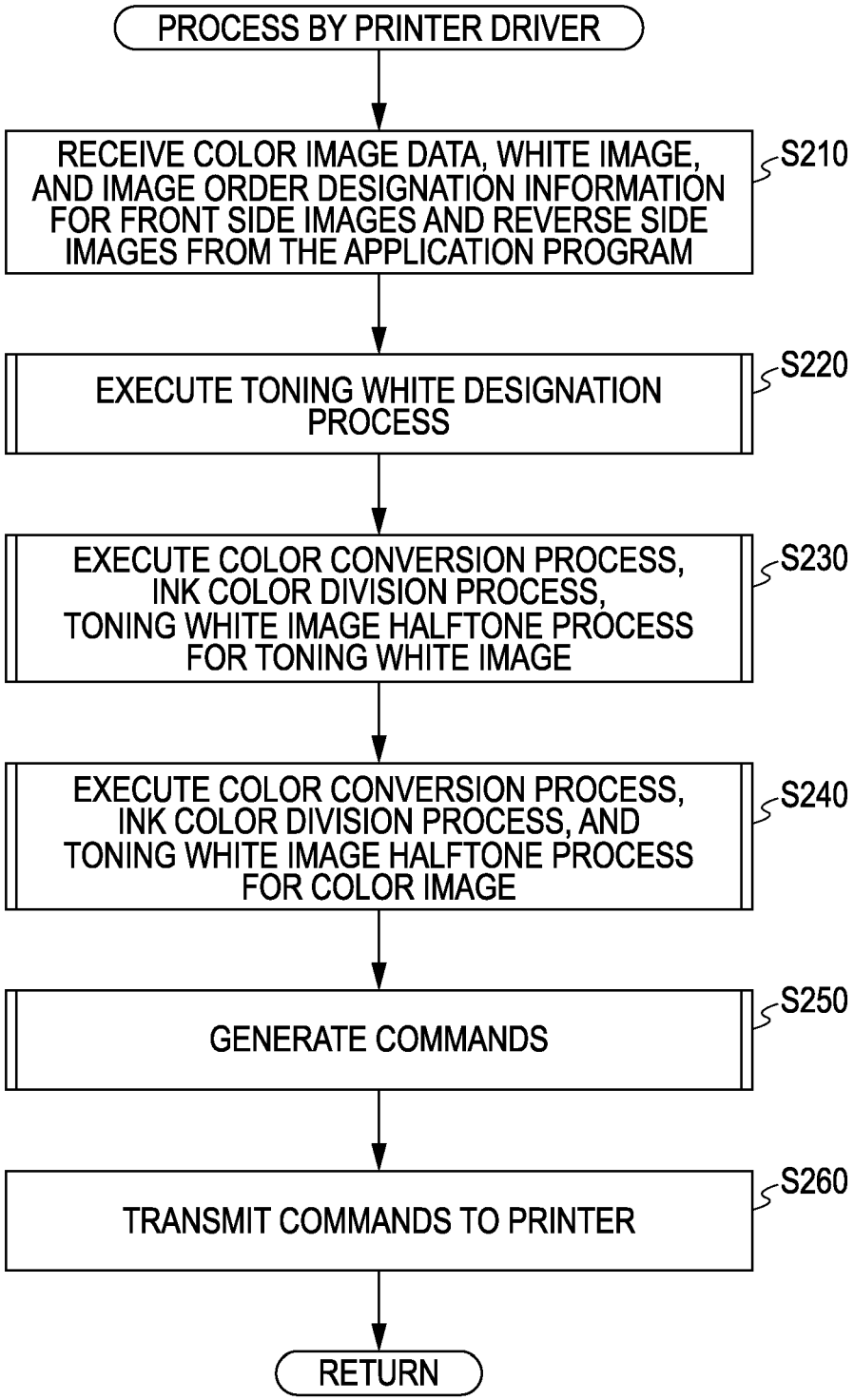
FIG. 9 is a flowchart illustrating the routine of a process executed by a CPU executing a printer driver.

In step S120 of the printing (see FIG. 6), a process by the CPU 210 executing the printer driver 300 (see FIG. 4) is executed. FIG. 9 is a flowchart illustrating a routine of the process by the CPU 210 executing the printer driver 300. In step S210, the CPU 210 receives the color image data Cdata, the white image data WIdata, and the image order designation information SS for the obverse side images and the reverse side images output from the application program AP (see FIG. 4).

In step S220 (see FIG. 9), the toning white designation module 330 (see FIG. 4) executes a toning white designation process. The toning white designation process is a process of designating the color of the white area Aw (see FIGS. 8B and 8D) of the first toning white image Iw1 and the second toning white image Iw2. The color of the white area Aw of the first toning white image Iw1 and the color of the white area Aw of the second toning white image Iw2 are set independently of each other.

Figure 10:
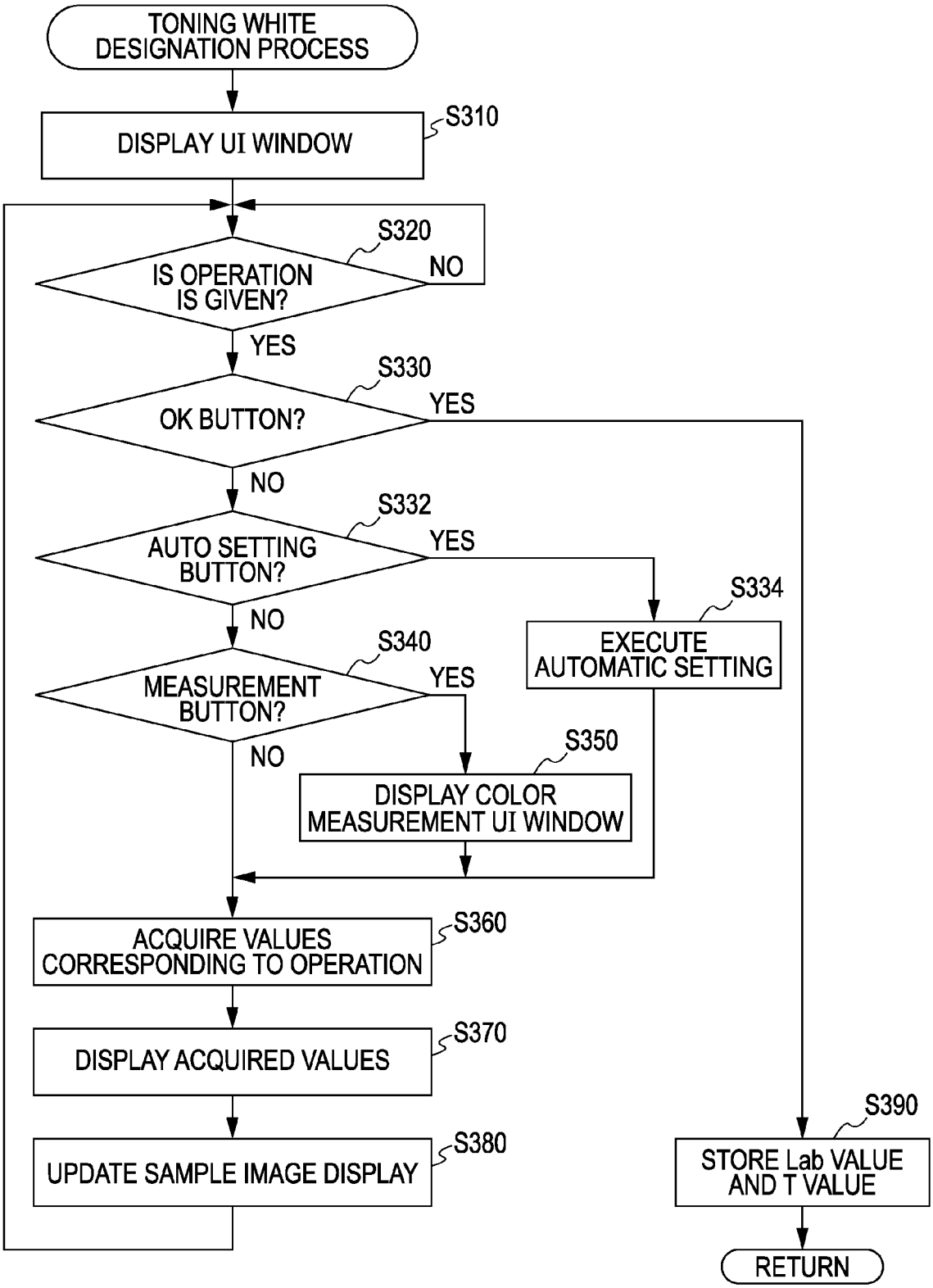
FIG. 10 is a flowchart illustrating the routine of a toning white designation process.

FIG. 10 is a flowchart illustrating the routine of the toning white designation process. In step S310, the UI control module 332 (see FIG. 4) of the toning white designation module 330 displays a UI window for the toning white designation on the Monitor MON (see FIG. 2) of the PC 200.

Figure 11A:
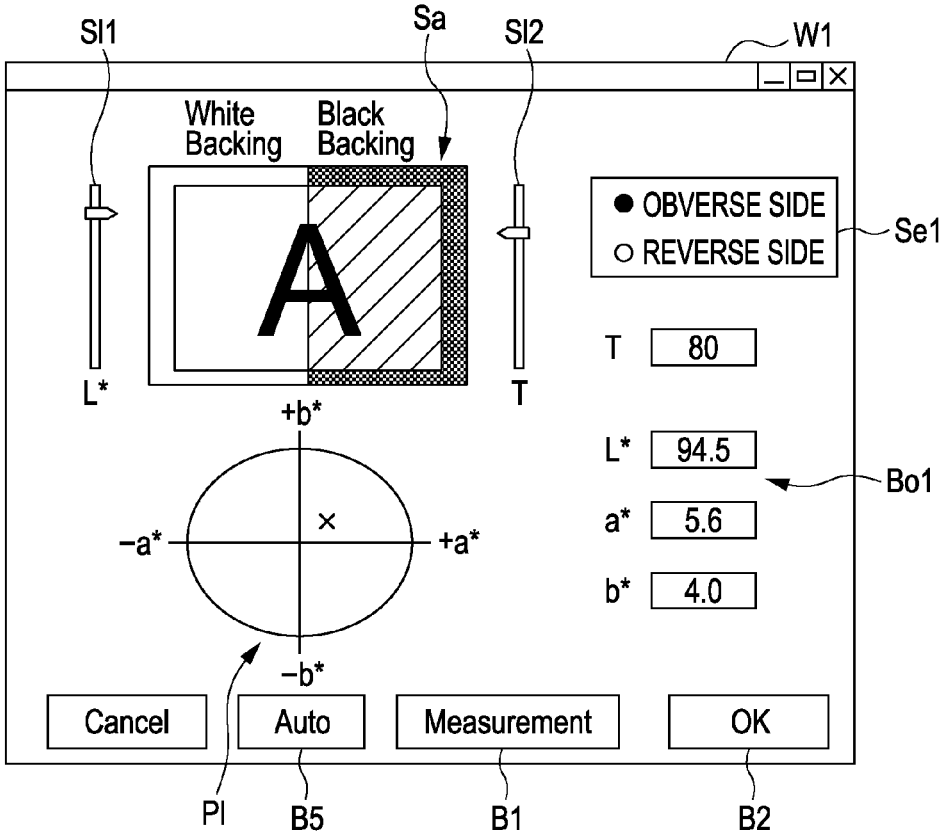
FIGS. 11A and 11B are explanatory diagrams illustrating an example of a UI window of toning white designation.
Figure 11B:
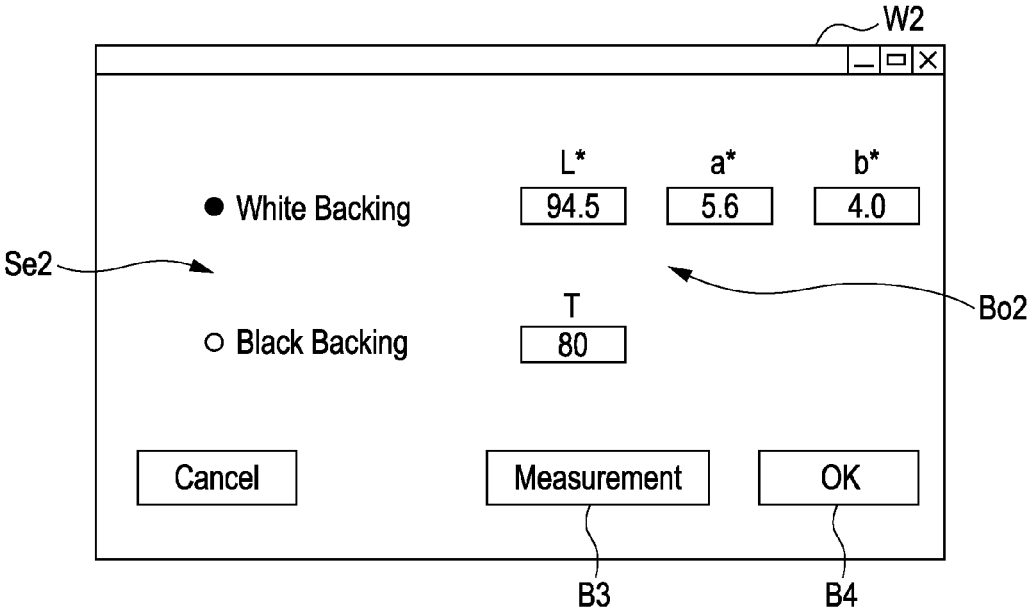

FIGS. 11A and 11B are explanatory diagrams illustrating an example of the UI window for the toning white designation. As shown in FIG. 11A, a UI window W1 for the toning white designation according to this embodiment has a sample image display area Sa, two slider bars Sl1 and Sl2, an ab plane display area P1, a setting image designation field Se1, a value input box Bo1, a measurement button B1, an OK button B2, and an auto button B5.

On the UI window W1 for the toning white designation shown in FIG. 11A, the sample image display area Sa is an area where a designated toning white sample image is displayed. The sample image display area Sa is divided into two areas on the right and left sides. On the right side, an area (white backing area) expresses the toning white on a white backing On the right side, an area (black backing area) exists for toning white on a black backing The outermost circumferential area of the sample image display area Sa is an area indicating the backing color (white or black). The area inside the outermost circumferential area is an area indicating the toning white. In the middle of the sample image display area Sa, a color image (image "A" in the drawing) is expressed on both the white backing area and the black backing area. The color and form of the color image can be arbitrarily set.

On the UI window W1 for the toning white designation, the value input box Bo1 is an area where an L* value (hereinafter, simply referred to as an "L value"), an a* value (hereinafter, simply referred to as an "a value"), a b* value (hereinafter, simply referred to as a "b value"), and a T value are input to designate the toning white. The L value is a value indicating brightness of the toning white and correlates with the amount of black (K) ink when the toning white image is printed. The a value and the b value are values indicating chromaticity along a red-green axis and a yellow-green axis of the toning white and correlate with the amount of color ink when the toning white image is printed. The T value is a value indicating the density and correlates with the amount of ink per unit area when the toning white image is printed. That is, the T value correlates with transmittance of a backing color.

On the UI window W1 for the toning white designation, the slider bars Sl1 and Sl2, and the ab plane display area P1 are areas where an Lab value and a T value are input to designate the toning white.

On the UI window W1 for the toning white designation, the setting image designation field Se1 is a field for designating a toning white designation target image (the first toning white image Iw1 or the second toning white image Iw2). That is, the setting image designation field Se1 is a field for determining whether the toning white designation target image is the first toning white image Iw1 (see FIG. 7A) of the reverse side image or the second toning white image Iw2 of the obverse side image.

When the UI window W1 for the toning white designation is initially displayed, the display state of the value input box Bo1, the sample image display area Sa, and the like is the display state corresponding to a default toning white. For example, the default state is a display state corresponding to the Lab value and the T value set in advance as the color of the white ink of the printer 100.

When the UI window W1 for the toning white designation is displaced, the UI control module 332 (see FIG. 4) monitors whether the user executes an operation using the keyboard KB or the mouse MOU (see FIG. 2) (step S320 in FIG. 10). When it is determined that the operation is executed (step S320: Yes) and the operation is executed using none of the OK button B2, the auto button B5, and the measurement button B1 (step S330: NO, step S332: No, and step S340: No), the UI control module 332 acquires a value corresponding to the operation (step S360), displays the acquired value on the value input box Bo1 (step S370), and then updates the display of the sample image display area Sa (step S380).

For example, when the user operates the keyboard KB (see FIG. 2) to select the value input box Bo1 and simultaneously inputs a value, the input value is displayed on the value input box Bo1 and the color of the sample image display area Sa is changed to a color (toning white) specified by the input value. When the user changes the a value or the b value in the value input box Bo1, the tinge of the color (toning white) of the sample image display area Sa is changed. When the user changes the L value in the value input box Bo1, the brightness of the sample image display area Sa is changed. When the user changes the T value in the value input box Bo1, the transmittance of the backing color is changed. Therefore, the brightness of the color in the black backing area of the sample image display area Sa is changed but the brightness of the color of the white backing area is not changed.

For example, when the user operates the mouse MOU (see FIG. 2) to changes the position of the slider bar Sl1, the L value corresponding to the position is acquired, and thus the color of the sample image display area Sa is changed to a color specified by the acquired value. Similarly, when the user operates the mouse MOU to change the position of the slider bar Sl2, the T value corresponding to the position is acquired, and thus the color of the sample image display area Sa is changed. In addition, when the user operates the mouse MOU to change the position of the designated point (indicated by X in the drawing) of the ab plane display area P1, the a value and the b value corresponding to the position of X are acquired, and thus the color of the sample image display area Sa is changed.

The value input box Bo1, the slider bars Sl1 and Sl2, and the ab plane display area P1 interlock with each other. That is, when the value is changed for the value input box Bo1, the positions of the slider bars Sl1 and Sl2 or the position of X in the ab plane display area P1 are changed. Similarly, when the positions of the slider bars Sl1 and Sl2 or the position of X in the ab plane display area P1 are changed, the changed designation value is displayed on the value input box Bo1.

In this embodiment, the toning white can be designated by measuring the color of the real print RP (see FIG. 1). When the toning white is designated by measuring the color of the real print RP, the printing can be realized so as to precisely reproduce the color of the white portion of the real print RP.

Figure 12A:
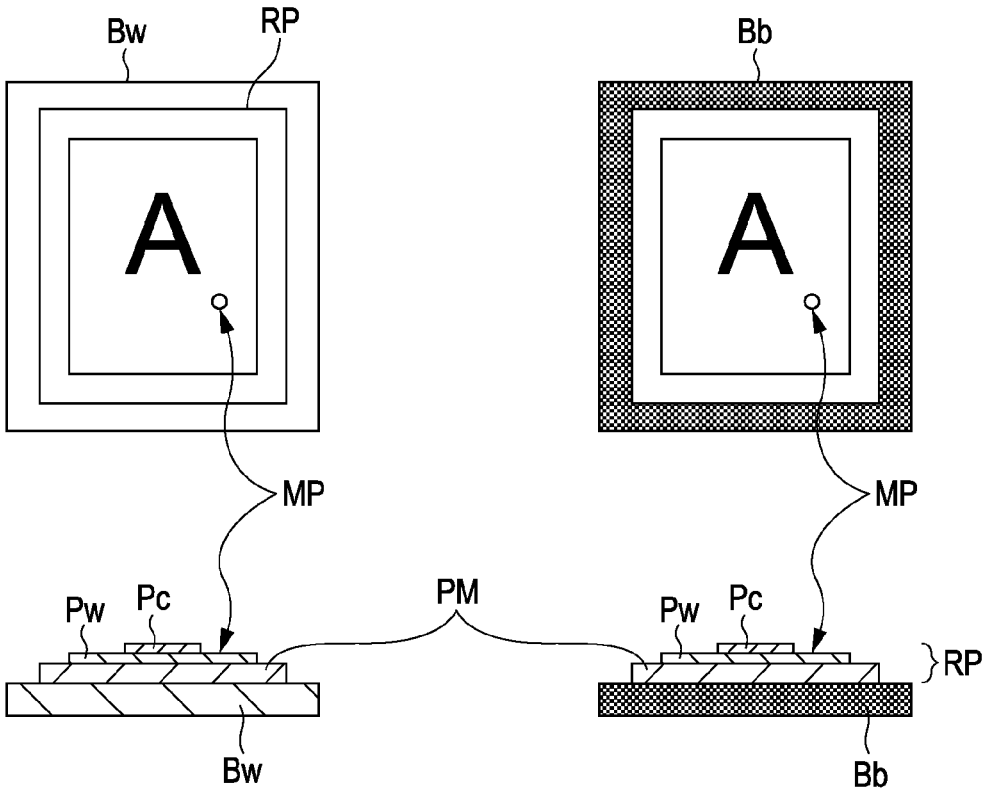
FIGS. 12A and 12B are explanatory diagrams illustrating a method of measuring the color of a real print.
Figure 12B:
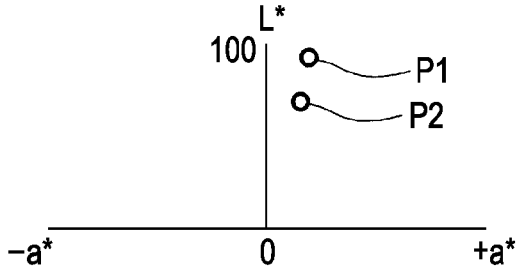

FIGS. 12A and 12B are explanatory diagrams illustrating a method of measuring the color of the real print RP. The real print RP is a print in which an image of a white portion Pw and an image of a color portion Pc are formed on a print medium PM. As shown in FIG. 12A, color measurement is executed by setting an arbitrary point of the white portion Pw of the real print RP as a measurement point MP and measuring the color (the Lab value and the T value) of the measurement point MP by the color measurement apparatus CM (see FIG. 2). Color measurement methods include a method of measuring the white backing color by placing the real print RP on the white backing Bw and a method of measuring the black backing color by placing the real print RP on the black backing Bb. As shown in FIG. 12B, the color measurement value (L value) obtained upon measuring the white backing color may be different from that obtained upon measuring the black backing color due to the density of the white portion Pw of the real print RP. In this embodiment, the measurement of the white backing color is executed to obtain the Lab value and the measurement of the black backing color is executed to obtain the T value.

When it is determined that the operation is executed in step S320 of FIG. 10 (step S320: Yes), the operation is executed using none of the OK button B2 and the auto button B5 (step S330: No and step S332: No), and it is determined that the operation is executed using the measurement button B1 (step S340: Yes), the UI control module 332 (see FIG. 4) displays a UI window W2 for the color measurement shown in FIG. 11B on the monitor MON (see FIG. 2) of the PC 200 (step S350).

The UI window W2 (see FIG. 11B) for the color measurement is a UI window for designating the toning white by measuring the color of the real print RP. The UI window W2 for the color measurement has a backing selection area Se2, a color measurement value box Bo2, a measurement button B3, and an OK button B4. The backing selection area Se2 is an area for selecting one of the measurement of the white backing color and the measurement of the black backing color. The user selects a color measurement method in the backing selection area Se2 and also selects the measurement button B3 to execute color measurement in accordance with the selected method. When the color measurement is completed, the values (the Lab value and the T value) corresponding to the color measurement result are obtained (step S360 in FIG. 10) and are displayed on the color measurement value display box Bo2 (step S370). When the user selects the OK button B4, the UI window W1 (see FIG. 11A) for the toning white designation is again displayed. At this time, the displays of the sample image display area Sa and the value input box Bo1 of the UI window W1 of the toning white designation are changed on the basis of the color measurement result (step S380).

When it is determined that the operation is executed in step S320 of FIG. 10 (step S320: Yes), and that the operation is executed using not the OK button B2 (step S330: No) but the auto button B5 (step S332: Yes), the automatic setting of the toning white is executed (step S334). In this embodiment, the automatic setting of the toning white is executed in accordance with the color image. Specifically, when the toning white designation target image is the first toning white image Iw1 organizing the reverse side image, the color of the toning white is set to a white having the tinge of the complementary color of the color of the first color image Ic1 organizing the same reverse side image. For example, when the color of the first color image Ic1 is red, the color of the first toning white image Iw1 is set to a white (white with cyan) having a tinge of cyan which is the complementary color of red. When the same toning white designation target image is the second toning white image Iw2 organizing the obverse side image, the color of the toning white is set to a white having a tinge of the complementary color of the color of the second color image Ic2 organizing the same obverse side image. In this way, since the toning white is set automatically, the color of the color image Ic is emphasized and thus the double-side print Pr with an improved contrast ratio can be generated.

When the first color image Ic1 or the second color image Ic2 is not a single-color image, the color of the toning white is set to a white having a tinge of the complementary color of the representative color of the first color image Ic1 or the second color image Ic2. The representative color of the first color image Ic1 or the second color image Ic2 is determined on the basis of the average of the pixel values of the color image Ic, for example.

The automatic setting of the toning white corresponding to the color image may be executed in accordance with another method. For example, scene determination of the color image Ic is executed and a predetermined toning white is set depending on the determined scene. A toning white having a tinge of the color (representative color) of the color image Ic to a preset degree may be set. The representative color of the color image Ic may be determined by determining a main subject by a process of dividing the area of the color image Ic, detecting a face, and acquiring focus position information.

When the automatic setting (step S334 in FIG. 10) of the toning white is completed, the values (the Lab value and the T value) of the set toning white are acquired (step S360) and are displayed on the color measurement value display box Bo2 (step S370). When the user selects the OK button B4, the UI window W1 (see FIG. 11A) for the toning white designation is again displayed. At this time, the state changed on the basis of the setting result is reflected on the display of the sample image display area Sa and the value input box Bo1 of the UI window W1 of the toning white designation (step S380).

When it is determined that the operation is executed in step S320 of FIG. 10 (step S320: Yes) and the operation is executed using the OK button B2 (step S330: Yes), the UI control module 332 (see FIG. 4) stores the Lab value and the T value (step S390). In accordance with the above-mentioned processes, the user can designate the color of toning white image accurately and easily. For example, when the Lab value and the T value of the toning white are designated on the basis of the color measurement result by the color measurement apparatus CM, the color of the toning white image Iw can be designated more accurately and easily. When the toning white is automatically set, it is possible to form the double-side print Pr in which the color of the color image Ic is emphasized to increase the contrast ratio. In this embodiment, the color of the toning white in the first toning white image Iw1 and the color of the toning white in the second toning white image Iw2 can be set independently of each other, it is possible to realize the double-side print Pr expressed with diverse colors. In this embodiment, since the toning white can be designated by the Lab value and the T value, it is possible to accurately designate the value of the color having the density of the toning white image. Since the designated color is displayed in the sample image display area Sa on the UI window W1 for the toning white designation according to this embodiment, the color can be easily designated while the user confirms the displayed color.

The process shown in FIG. 10 is executed on both of the first toning white image Iw1 organizing the reverse side image and the second toning white image Iw2 organizing the reverse side image. The method of designating the toning white may not be the same in the first toning white image Iw1 and the second toning white image Iw2. For example, the color of the first toning white image Iw1 may be set on the basis of the color measurement result, and the color of the second toning white image Iw2 may be set automatically.

The stored Lab value and T value can be combined with the white image data WIdata (see FIGS. 8B and 8D). That is, as for the white data WIdata, the Lab value and the T value can correspond to the pixels to which the data (W=255) representing the formation of the toning white image can be assigned. In the specification, the white image data WIdata to which the Lab value and the T value can correspond is also referred to as toning white image data.

In step S230 of the process (see FIG. 9) executed by the printer driver 300, the printer driver 300 executes the color conversion process, the ink color division process, and the toning white image halftone process for the toning white image. The color conversion process, the ink color division process, the toning white image halftone process for the toning white image are executed on the first toning white image Iw1 and the second toning white image Iw2 using the first white image data WIdata1 and the second white image data WIdata2, respectively. Hereinafter, the color conversion process, the ink color division process, and the toning white image halftone process for the toning white image executed on the first toning white image Iw1 and the second toning white image Iw2 will be described.

Figure 13:
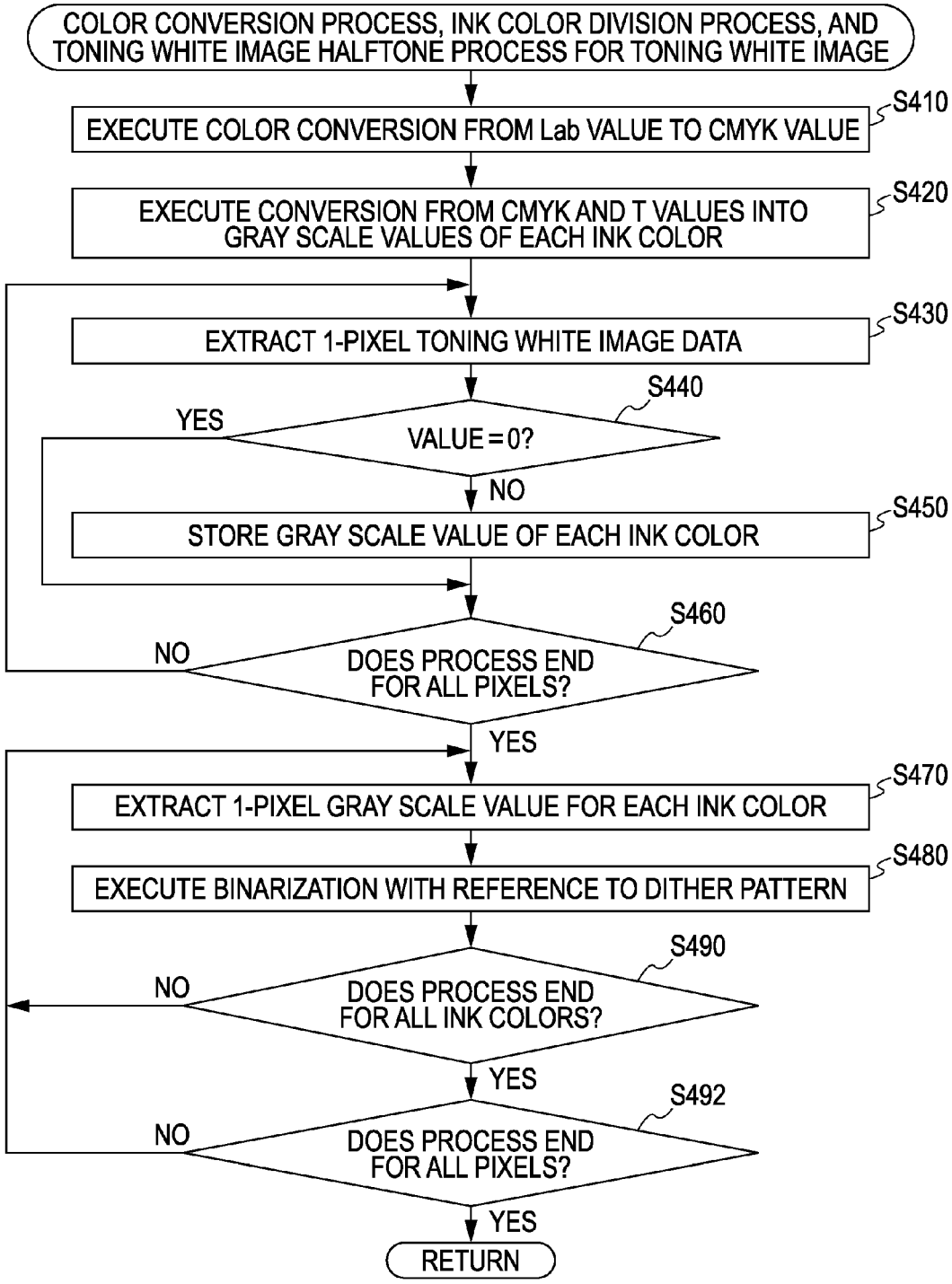
FIG. 13 is a flowchart illustrating the routine of a color conversion process, an ink color division process, and a halftone process for a toning white image.

FIG. 13 is a flowchart illustrating the routine of the color conversion process, the ink color division process, and the halftone process for the toning white image. In step S410, the toning white image color conversion module 340 (see FIG. 4) executes color conversion of the Lab value stored in step S390 of the toning white designation process (see FIG. 10) to CMYK value. The color conversion is executed with reference to a toning white image lookup table LUTw (see FIG. 4).

FIGS. 14A and 14B are explanatory diagrams partially illustrating examples of the toning white image lookup tables LUTw. FIG. 14A shows a toning white image lookup table LUTw1 referred to when the color conversion from the Lab value to the CMYK value is executed. As shown in FIG. 14A, the toning white image lookup table LUTw1 defines a corresponding relation between the preset Lab value and the preset CMYK value. In the toning white image lookup table LUTw1, gray scale values of CMYK are defined in the range from 0 to 100. The toning white image color conversion module 340 converts the Lab value to the CMYK value with reference to the toning white image lookup table LUTw1.

In step S420 (see FIG. 13), the toning white image ink division process module 350 (see FIG. 4) executes an ink color division process of converting combinations of the CMYK values determined in step S410 and the T values stored in step S390 of the toning white designation process (see FIG. 10) into gray scale values for each ink color. As described above, the printer 100 according to this embodiment executes the printing using a total of seven kinds of ink: cyan (C) ink, magenta (M) ink, yellow (Y) ink, black (K) ink, light cyan (Lc) ink, light magenta (Lm) ink, and white (W) ink. Accordingly, in the ink color division process, the combinations of the CMYK values and the T values are converted into the gray scale values of the respective seven ink colors. The ink color division process is also executed with reference to the toning white image lookup table LUTw (see FIG. 4). FIG. 14B shows a toning white image lookup table LUTw2 referred to at the time of the conversion from the combinations of the CMYK values and the T values into the gray scale values for each ink color. As shown in FIG. 14B, the toning white image lookup table LUTw2 defines a corresponding relation between the preset combinations of the CMYK values and the preset T values and the preset gray scale values of the respective ink colors. In the toning white image lookup table LUTw2, gray scale values of the ink colors are defined in the range from 0 to 255. The toning white image ink color division process module 350 converts the combinations of the CMYK values and the T values into the gray scale values for ink colors with reference to the toning white image lookup table LUTw2.

In this embodiment, as shown in FIG. 14B, four color kinds of ink such as yellow (Y) ink, black (K) ink, light cyan (Lc) ink, and light magenta (Lm) ink are used among the six color kinds of ink other than white in a white toning color (which is a color obtained by mixing another color ink in the white ink to adjust the white). Two color kinds of ink, that is, the cyan (C) ink and the magenta (M) ink are not used. That is, between the two kinds of ink, that is, the light color ink and the dark color ink for the same color ink, the dark ink is not used for the white toning color.

In step S430 (see FIG. 13), the toning white image ink color division process module 350 (see FIG. 4) extracts 1-pixel data from the toning white image data. In step S440, the toning white image ink color division process module 350 determines whether the extracted pixel value is a value (0) indicating that no toning white image is formed or a value (255) indicating that the toning white image is formed. When it is determined that the pixel value is 255 (step S440: No), the toning white image ink color division process module 350 stores the gray scale value of each ink color determined in step S420 (step S450). Alternatively, when it is determined that the pixel value is 0 (zero) (step S440: Yes), the process of step S450 is skipped.

Steps S430 to S450 of FIG. 13 are repeatedly executed until the process ends for all of the pixels of the toning white image data (see step S460). When the process ends for all of the pixels (step S460: Yes), the toning white image halftone process module 360 (see FIG. 4) extracts a 1-pixel gray scale value of each ink color (step S470) and executes binarization with reference to a dither pattern for each ink color (step S480). The binarization process is executed with reference to a preset toning white image halftone resource HTw (see FIG. 4). The toning white image halftone resource HTw is set by emphasizing the fullness of dots in the toning white image. The binarization process is executed repeatedly until the process ends for all of the ink colors (see step S490). Steps S470 to S490 are executed repeatedly until the process ends for all of the pixels (see step S492).

Toning white image dot data defining ON/OFF of dots of each ink color of each pixel upon forming the toning white image are generated by the color conversion process, the ink color division process, and the halftone process for the toning white image shown in FIG. 13.

In step S240 of the process (see FIG. 9) executed by the printer driver 300, the printer driver 300 executes the color conversion process, the ink color division process, and the halftone process for the color image. The color conversion process, the ink color division process, and the halftone process for the color image are executed on the first color image Ic1 and the second color image Ic2 using the first color data Cdata1 and the second color data Cdata2, respectively. Hereinafter, the color conversion process, the ink color division process, and the toning white image halftone process for the color image executed on the first color image Ic1 and the second color image Ic2 will be described.

Figure 15:
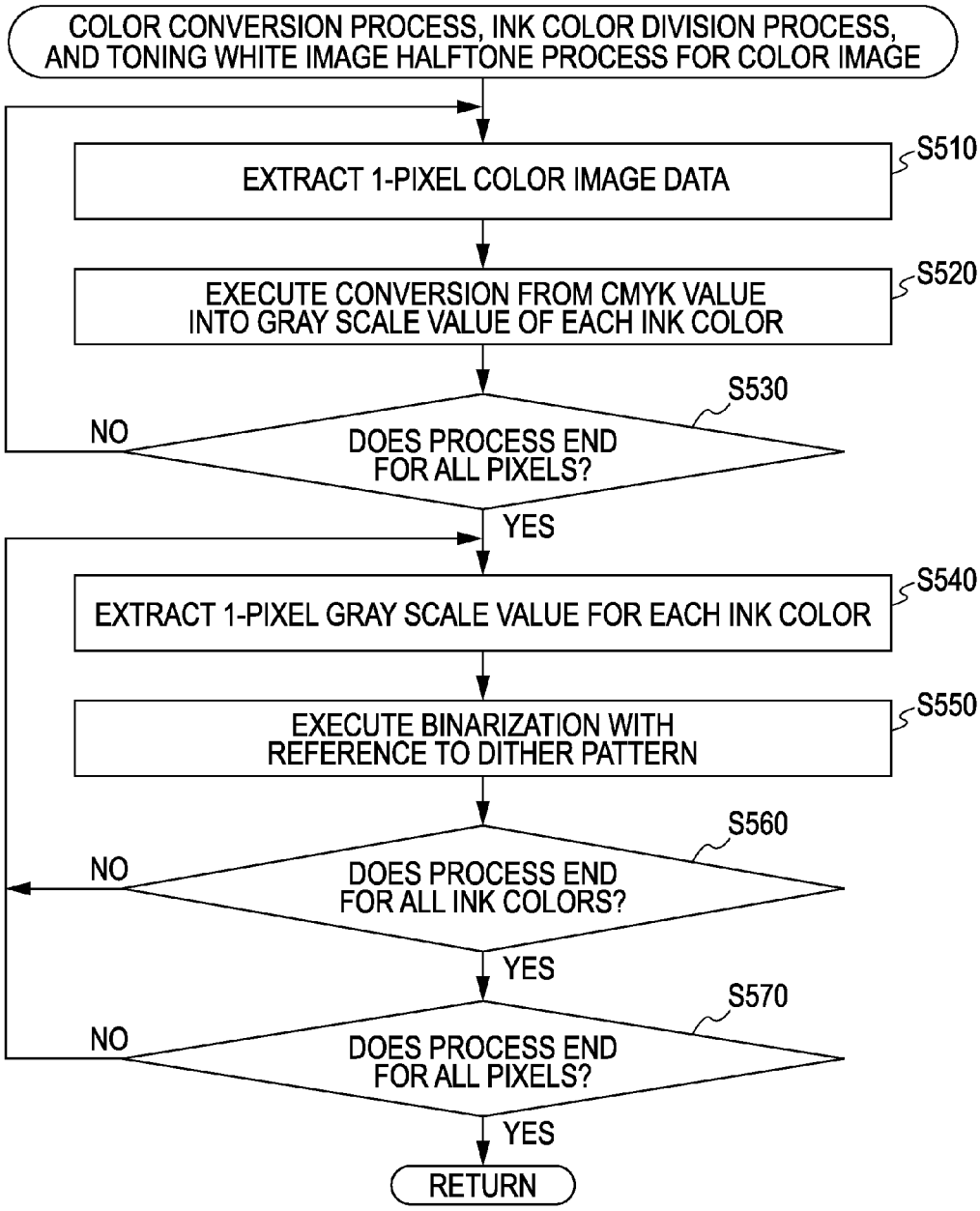
FIG. 15 is a flowchart illustrating the routine of a color conversion process, an ink color division process, and a halftone process for a color image.

FIG. 15 is a flowchart illustrating the routine of the color conversion process, the ink color division process, and the halftone process for the color image. In step S510, the ink color division process module 310 for the color image (see FIG. 4) extracts 1-pixel data from the color image data. In step S520, the ink color division process module 310 for the color image executes the ink color division process of converting the extracted 1-pixel data (CMYK value) into the gray scale value of each ink color. As described above, the printer 100 according to this embodiment executes the printing using a total of seven kinds of ink: cyan (C) ink, magenta (M) ink, yellow (Y) ink, black (K) ink, light cyan (Lc) ink, light magenta (Lm) ink, and white (W) ink. Accordingly, in the ink color division process, the CMYK values are converted into gray scale values of the seven kinds of ink. The ink color division process is executed with reference to the color image lookup table LUTc (see FIG. 4).

FIG. 16 is an explanatory diagram partially illustrating an example of the color image lookup table LUTc. As shown in FIG. 16, the color image lookup table LUTc defines a corresponding relation between the preset CMYK values and the preset gray scale values of the ink colors. In the color image lookup table LUTc, the gray scale values of CMYK are defined in the range from 0 to 100. The gray scale values of the ink colors are defined in the range from 0 to 255. The ink color division process module 310 for the color image converts the CMYK values into the gray scale values of each ink color with reference to the color image lookup table LUTc. In this embodiment, as shown in FIG. 16, six kinds of ink other than white are used and the white ink is not used upon forming the color image.

Steps S510 to S520 of FIG. 15 are executed repeatedly until the process ends for all of the pixels of the color image data (see step S530). When the process ends for all of the pixels (step S530: Yes), the color image halftone process module 320 (see FIG. 4) extracts a 1-pixel gray scale value of each ink color (step S540) and executes a binarization process (halftone process) with reference to a dither pattern of each ink color (step S550). The binarization process is executed with reference to the preset color image halftone resource HTc (see FIG. 4). The color image halftone resource HTc may be set by emphasizing suppression of granularity. The binarization process is executed repeatedly until the process ends for all of the ink colors (see step S560). Steps S540 to S560 are executed repeatedly until the process ends for all of the pixels (see step S570).

Color image dot data defining ON/OFF of dots of each ink color of each pixel upon forming the color image are generated by the color conversion process, the ink color division process, and the halftone process for the color image shown in FIG. 15.

Figure 17:
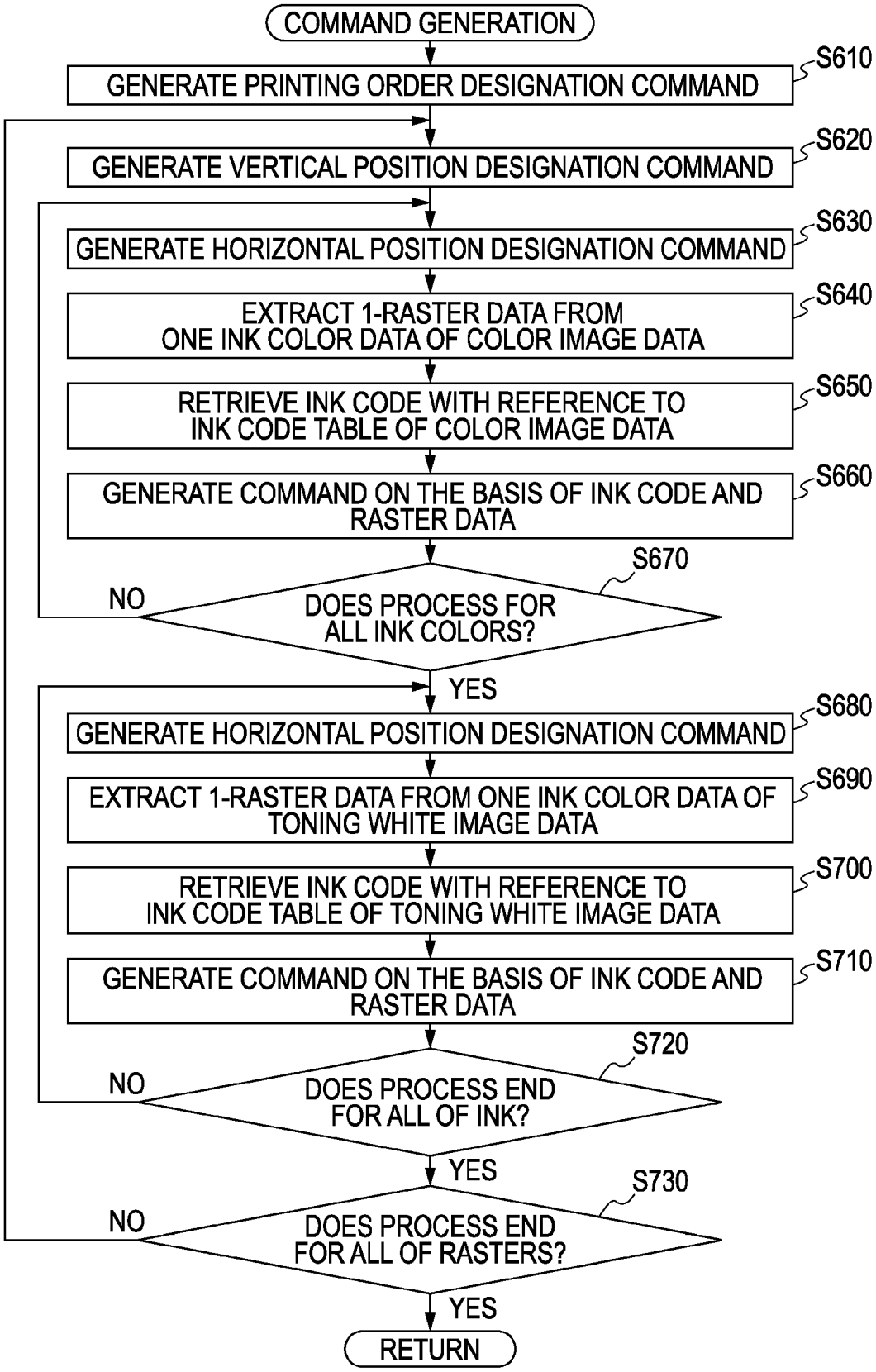
FIG. 17 is a flowchart illustrating the routine of a command generation process.

In step S250 of the process (see FIG. 9) executed by the printer driver 300, the command generation module 370 (see FIG. 4) of the printer driver 300 executes a command generation process. FIG. 17 is a flowchart illustrating the routine of the command generation process.

Figure 18A:
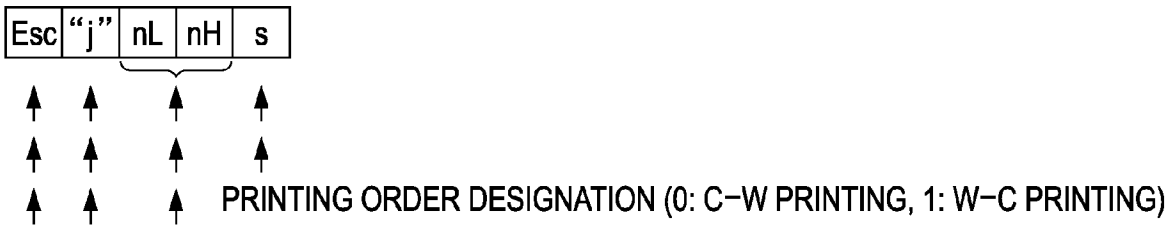
FIGS. 18A and 18B are explanatory diagrams illustrating an example of a command generated by the command generation process.
Figure 18B:
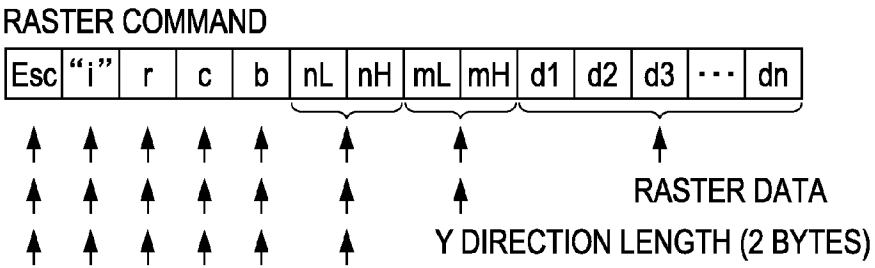

In step S610 of the command generation process (see FIG. 17), the command generation module 370 (see FIG. 4) generates a printing order designation command on the basis of the image order designation information SS output from the application program AP. FIGS. 18A and 18B are explanatory diagrams illustrating examples of commands generated by the command generation process. FIG. 18A shows the example of the printing order designation command. In FIG. 18A, the printing order designation command contains an identifier indicating a command head, an identifier indicating a printing order designation command, and a command length (two bytes), and a printing order designation. As for the printing order designation, for example, a value "0" indicates the C-W printing (in printing order in which the color image Ic is first formed and then the toning white image Iw is formed on the color image Ic), and a value "1" indicates the W-C printing (in the printing order in which the toning white image Iw is first formed and the color image Ic is formed on the toning white image Iw). Referring to the image order designation information SS, the command generation module 370 determines whether each image data is data used to form the reserve side image (see FIGS. 7A and 7B) or data used to form the obverse side image. When each image data is the data used to form the reserve side image, the printing order is determined in accordance with the C-W printing. Alternatively, when each image data is the data used to form the obverse side image, the printing order is determined in accordance with the W-C printing and the printing order designation command designating the determined printing order is generated.

In step S620 (see FIG. 17), the command generation module 370 (see FIG. 4) generates a vertical position designation command on the basis of the color image dot data received from the color image halftone process module 320 and the toning white image dot data received from the toning white image halftone process module 360. The vertical position designation command is a command used to designate the printing start position of an image in a vertical direction (Y direction). The vertical position designation command is generated as a common command for all the ink.

Subsequently, the command generation module 370 (see FIG. 4) generates a raster command corresponding to the color image in the process from steps S630 to S670 (see FIG. 17). In step S630, the command generation module 370 generates a horizontal position designation command for the selected one ink color on the basis of the color image dot data. The horizontal position designation command is a command designating the printing start position of an image in a horizontal direction (X direction) for one ink color when the color image is formed. The command generation module 370 generates the horizontal position designation command by setting the appropriate start position of an image with reference to the color image dot data for one ink color.

In step S640 (see FIG. 17), the command generation module 370 (see FIG. 4) extracts 1-raster dot data for the selected one ink color from the color image dot data. In step S650, the command generating module 370 retrieves an ink code with reference to an ink code table ICT. FIG. 19 is an explanatory diagram illustrating an example of the details of the ink code table ICT. In this embodiment, as shown in FIG. 19, the unique ink abbreviation name and ink code of each ink color can be assigned. In this embodiment, it is assumed that two different ink abbreviation names and ink codes for the color image and the toning white image can be assigned to one ink color. That is, the ink abbreviation names and the ink codes uniquely correspond to the combinations of the color images and the toning white images of plural ink colors. For example, as for cyan, an ink abbreviation name "C" and the ink code "01H" can be assigned for the color image and an ink abbreviation name "WC" and an ink code "81H" can be assigned for the toning white image. Likewise, as for white, an ink abbreviation name "IW" and the ink code "40H" can be assigned for the color image and an ink abbreviation name "W" and an ink code "C0H" can be assigned for the toning white image. In this step (S650), the command generation module 370 retrieves the ink code for the color image of the ink code table ICT.

In step S660 (see FIG. 17), the command generation module 370 (see FIG. 4) generates the raster command on the basis of the extracted 1-raster dot data and the retrieved ink code. FIG. 18B shows an example of the raster command. As shown in FIG. 18B, the raster command contains an identifier indicating a command head, an identifier indicating the raster command, an ink code, an identifier indicating whether data is compressed, a bit number for about one pixel, an X direction length (2 bytes), a Y direction length (2 bytes), and raster data (dot data).

Steps S630 to S660 of the command generation process (see FIG. 17) are executed repeatedly until the process ends for all of the ink colors used to form the color image. That is, when the ink color which is not yet the processing target is present (step S670: No), one ink color which is not the processing target is selected and steps from S630 to S660 are executed on the selected ink color. When the process ends for all of the ink (step S670: Yes), the generation of the raster command corresponding to each of the ink colors used to form the color image is completed.

Subsequently, the command generation module 370 (see FIG. 4) generates a raster command corresponding to the toning white image in the process from steps S680 to S720 (see FIG. 17). In step S680, the command generation module 370 generates a horizontal position designation command for the selected one ink color on the basis of the toning white image dot data. The horizontal position designation command is a command designating the printing start position of an image in the horizontal direction (X direction) for one ink color when the toning white image is formed. The command generation module 370 generates the horizontal position designation command by setting the appropriate start position of an image with reference to the toning white image dot data for one ink color.

In step S690 (see FIG. 17), the command generation module 370 (see FIG. 4) extracts 1-raster dot data for the selected one ink color from the toning white image dot data. In step S700, the command generating module 370 retrieves an ink code with reference to the ink code table ICT. The command generation module 370 retrieves the toning white image ink code of the ink code table ICT (see FIG. 19).

In step S710 (see FIG. 17), the command generation module 370 (see FIG. 4) generates the raster command (see FIG. 18B) on the basis of the extracted 1-raster dot data and the retrieved ink code. Steps S680 to S710 of the command generation process are executed repeatedly until the process ends for all of the ink colors used to form the toning white image. That is, when the ink color which is not yet the processing target is present (step S720: No), one ink color which is not the processing target is selected and steps from S680 to S710 are executed on the selected ink color. When the process ends for all of the ink (step S720: Yes), the generation of the raster command corresponding to each of the ink colors used to form the toning white image is completed for one raster.

Steps S620 to S720 of the command generation process (see FIG. 17) are executed repeatedly until the process is completed for all of the rasters of a print image PI. That is, when the raster which is not yet the processing target is present (step S730: No), the raster (one raster of the previous processing target rasters) which is not yet the processing target is selected, and then steps S620 to S720 are executed on the selected raster. When the process ends for all of the rasters (step S730: Yes), the generation of the command corresponding to each ink color used to form the color image and the toning white image is completed for all of the rasters.

In step S260 of the process (see FIG. 9) executed by the printer driver 300, the printer driver 300 transmits the printing order designation command generated in step S250, the vertical position designation command, the horizontal position designation command, and the raster command to the printer 100. In this way, the process executed by the printer driver 300 is completed.

In step S130 of the printing (see FIG. 6), the printing is executed by the printer 100. In the process executed by the printer 100, as described below, the reverse side images (the first color image Ic1 and the first toning white image Iw1 and see FIGS. 7A and 7B) are first printed, and the print medium is rewound by the rewind mechanism 190, and then the obverse side images (the second color image Ic2 and the second toning white image Iw2) are printed. When the reverse side images are printed, the first color image Ic1 and the first toning white image Iw1 are formed concurrently. When the obverse side images are printed, the second color image Ic2 and the second toning white image Iw2 are printed concurrently.

Figure 20:
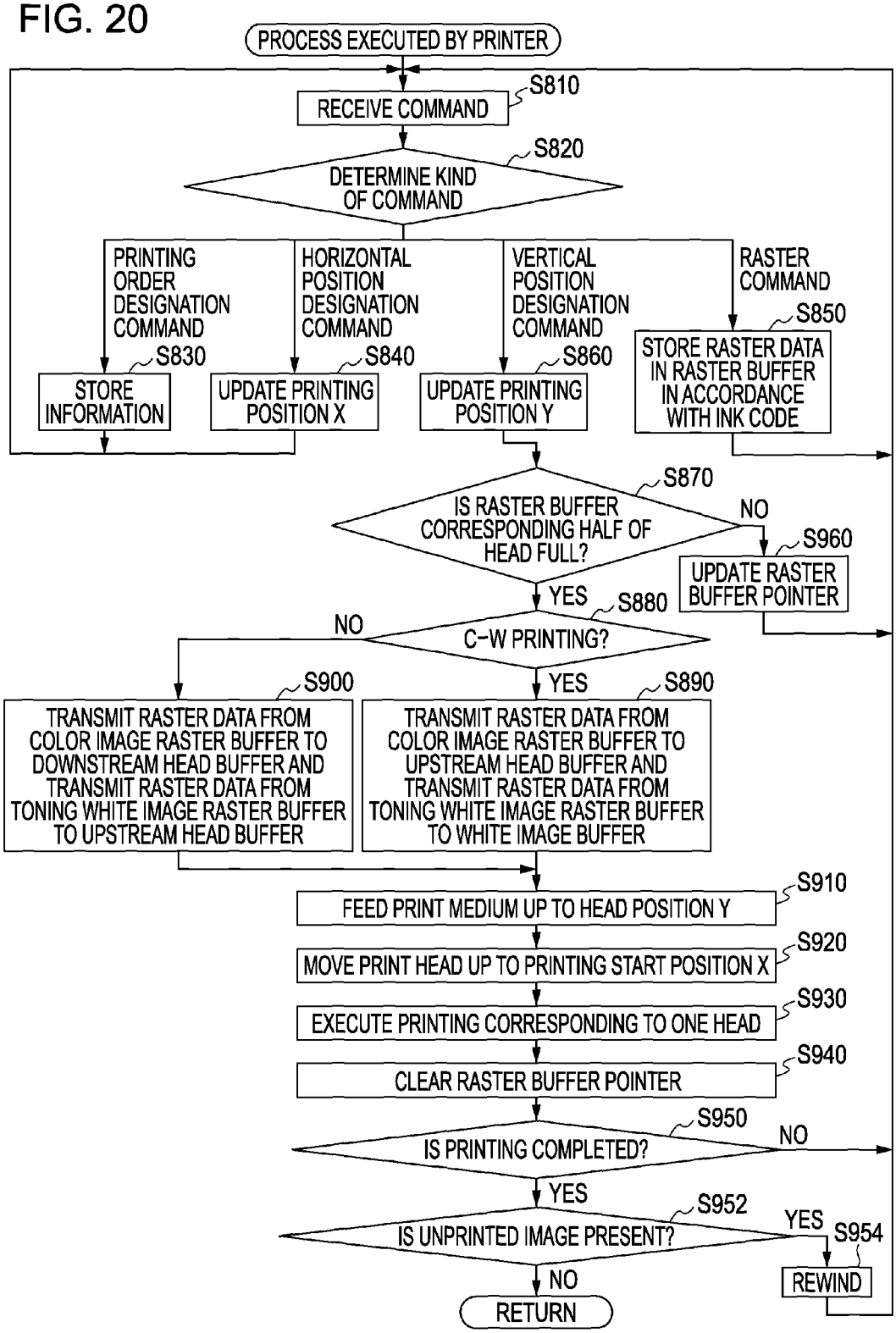
FIG. 20 is a flowchart illustrating the routine of a process executed by the printer.

FIG. 20 is a flowchart illustrating the routine of the process executed by the printer 100. In step S810, the CPU 110 (see FIG. 3) executing the command process module 112 (see FIG. 5) of the printer 100 receives the command transmitted from the printer driver 300 of the PC 200. The CPU 110 determines the kind of command received (step S820) and executes a process in accordance with the kind of command. When the received command is the printing order designation command, the CPU 110 stores information indicating the printing order designated by the printing order designation command in the RAM 130 (step S830). When the received command is the horizontal position designation command, the printing start position X in the horizontal direction is updated (step S840).

Figure 21:
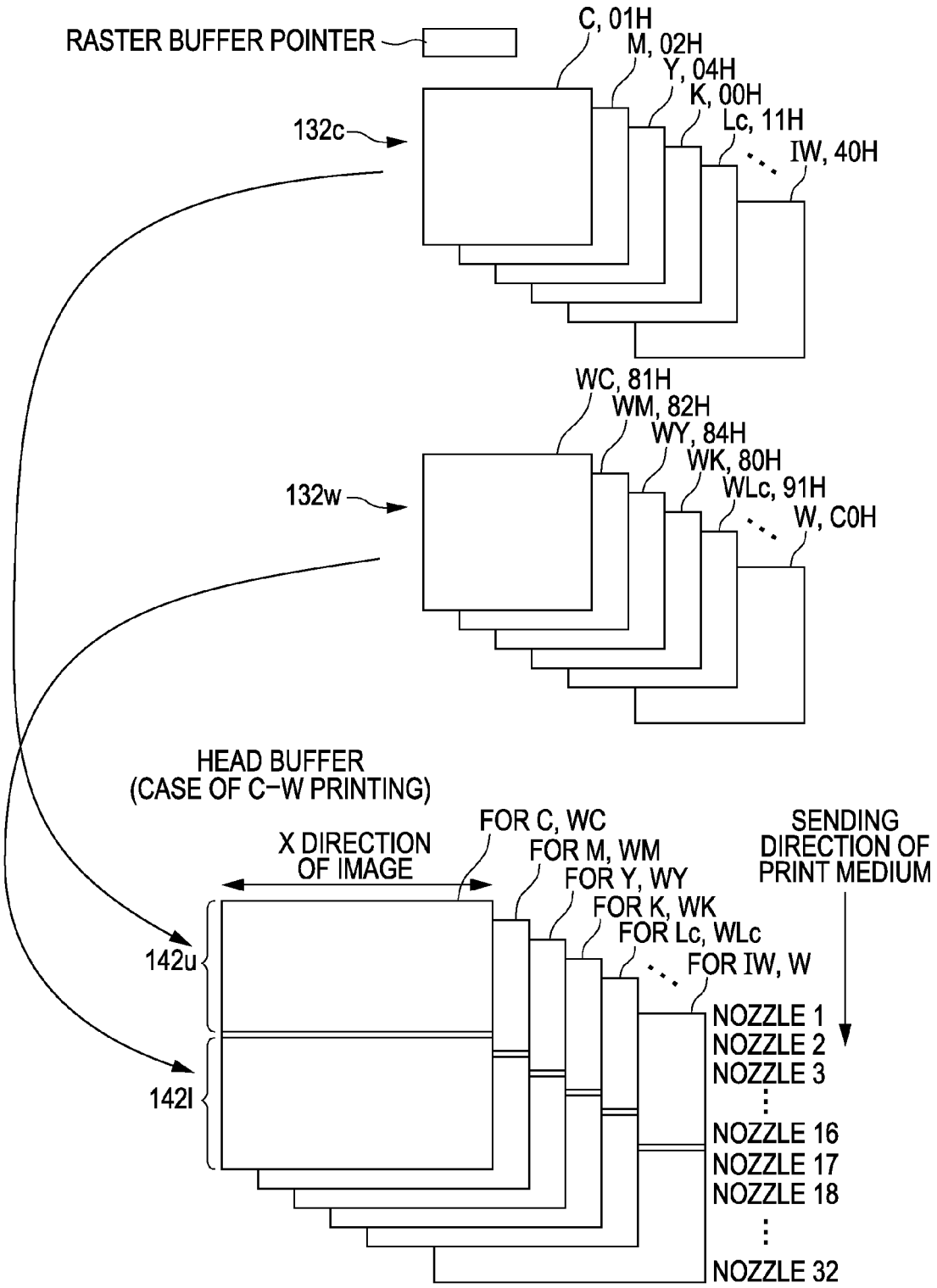
FIG. 21 is an explanatory diagram illustrating the detailed configuration of a raster buffer and a head buffer.

When the received command is the raster command, the CPU 110 (see FIG. 3) executing the command process module 112 (see FIG. 5) stores the raster data (dot data) contained in the raster command in the raster buffer 132 (see FIG. 5) in accordance with the ink code (step S850). FIG. 21 is an explanatory diagram illustrating the detailed configurations of the raster buffer and the head buffer. In the upper part of the FIG. 21, the color image raster buffer 132*c* is shown. In the middle part of FIG. 21, the toning white image raster buffer 132*w* is shown. As shown in FIG. 21, the raster buffer 132 can allocate an area in accordance with the ink code (see FIG. 19). That is, the color image raster buffer 132*c* is configured as a set of areas corresponding to the color image ink codes, respectively. The toning white image raster buffer 132*w* is also configured as a set of areas corresponding to the toning white image ink codes. The size of each area in an X direction in the raster buffer 132 corresponds to an image size. The size of each area in a Y direction is half or more of the height of the print head 144. The raster buffer 132 has a raster buffer pointer in the Y direction, which indicates up to where the raster data has been received.

In the lower part of FIG. 21, the head buffer 142 (see FIG. 5) is shown. As shown in FIG. 21, the head buffer 142 can allocate areas in accordance with the seven kinds of ink. That is, the head buffer 142 is configured as a set of a cyan (C, WC) area, a magenta (M, WM) area, a yellow (Y, WY) area, a black (K, WK) area, a light cyan (Lc, WLc) area, a light magenta (Lm, WLm) area, and a white (IW, W) area. The size of each area in the X direction in the head buffer 142 corresponds to a scanning distance of the carriage. The size of each area in the Y direction corresponds to the number of nozzles of a nozzle row 146 of the print head 144. Each area of the head buffer 142 in accordance with the kinds of ink is halved into an upstream side 142*u* and a downstream side 1421.

Figure 22A:
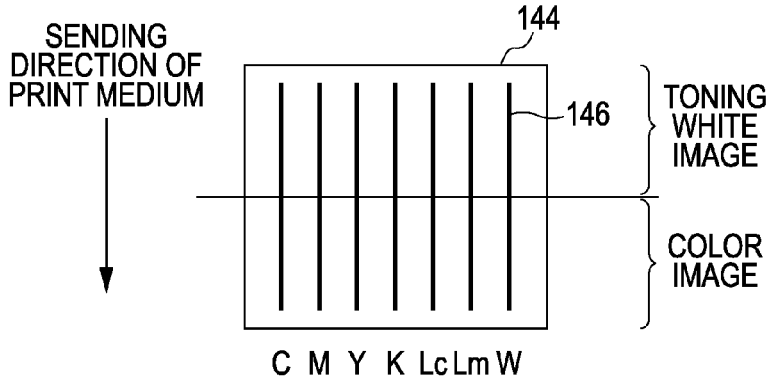
FIGS. 22A to 22C are explanatory diagrams illustrating the configuration of a print head of the printer.
Figure 22B:
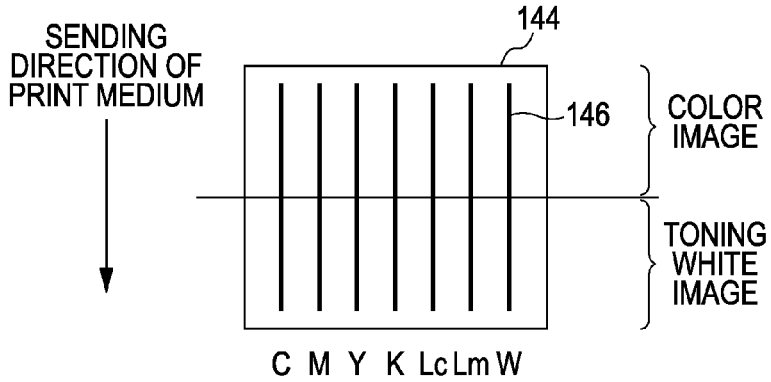
Figure 22C:
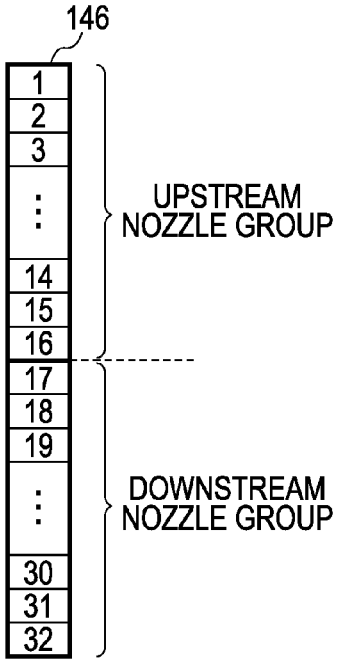

FIGS. 22A to 22C are explanatory diagrams illustrating the configuration of the print head 144 of the printer 100. In the print head 144, as shown in FIGS. 22A and 22B, the nozzle rows 146 corresponding to the seven ink colors, respectively, are formed. The nozzle rows 146 extend in the Y direction (direction in which the print medium is sent). As shown in FIG. 22C, each nozzle row 146 is organized by thirty two nozzle groups in a sending direction of the print medium. Of the nozzle groups organizing each nozzle row 146, a nozzle group (group from the first nozzle (nozzle 1) to the sixteenth nozzle (nozzle 16)) located in the half of the nozzle row on the upstream side in the sending direction of the print medium is referred to as an upstream nozzle group, and a nozzle group (group from the seventeenth nozzle (nozzle 17) to the thirty second nozzle (nozzle 32)) located on the half of the nozzle row on the downstream side in the sending direction of the print medium is referred to as a downstream nozzle group.

Upon the W-C printing, as shown in FIG. 22A, the upstream nozzle group and the downstream nozzle group of each nozzle row 146 of the print head 144 are used to form the toning white image and the color image, respectively. Upon the C-W printing, as shown in FIG. 22B, the upstream nozzle group and the downstream nozzle group of each nozzle row 146 of the print head 144 are used to form the color image and the toning white image. Upon the W-C printing, the upstream nozzle group and the downstream nozzle group of each nozzle row 146 of the print head 144 correspond to a second nozzle group and a first nozzle group of the embodiment of the invention, respectively. On the contrary, upon the C-W printing, the upstream nozzle group and the downstream nozzle group of each nozzle row 146 of the print head 144 correspond to the first nozzle group and the second nozzle group of the embodiment of the invention, respectively.

As shown in FIG. 21, the upstream head buffer 142*u* is the head buffer 142 corresponding to the portion (the upstream nozzle group) of the print head 144 on the upstream side in the sending direction of the print medium. The downstream head buffer 1421 is the head buffer 142 corresponding to the portion (the downstream nozzle group) of the print head 144 on the downstream side in the sending direction of the print medium.

In step S850 of FIG. 20, the CPU 110 (see FIG. 3) refers to the ink code contained in the received raster command to store the raster data at a position designated by the raster buffer pointer of the raster buffer 132 corresponding to the ink code. Therefore, the CPU 110 can sort the raster data to the appropriate raster buffer 132 without distinguishing the raster command for the color image from the raster command for the toning white image.

The CPU 110 (see FIG. 3) executing the command process module 112 (see FIG. 5) updates the printing start position Y in the vertical direction, when the received command is the vertical position designation command (step S860). Subsequently, the CPU 110 determines whether the raster buffer 132 corresponding to the half of the height of the print head 144 (see FIG. 5) is full (that is, whether the raster data is stored) (step S870). When it is determined that the raster buffer 132 is not yet full (step S870: No), the CPU 110 updates the raster buffer pointer of the raster buffer 132 (step S880).

When the raster data is stored in the raster buffer 132 corresponding to the half of the height of the print head 144 by repeatedly executing the above process, it is determined that the raster buffer 132 corresponding to the half of the height of the print head 144 is full (S870: Yes). At this time, the CPU 110 (see FIG. 3) determines whether the printing order corresponds to the C-W printing or the W-C printing on the basis of the information, which is stored in the RAM 130, indicating the printing order (step S880). When it is determined that the printing order corresponds to the C-W printing (step S880: Yes), the CPU 110 transmits the raster data from the color image raster buffer 132*c* to the upstream head buffer 142*u* (see FIG. 5) and simultaneously transmits the raster data from the toning white image raster buffer 132*w* to the downstream head buffer 1421 (see FIG. 5) (step S890). FIG. 21 shows a case where the raster data is transmitted from the color image raster buffer 132*c* to the upstream head buffer 142*u* and the raster data is transmitted from the toning white image raster buffer 132*w* to the downstream head buffer 1421 when the printing order corresponds to the C-W printing. In this way, prepared is the C-W printing (see FIG. 22B) of forming the color image and the toning white image by using the upstream nozzle group and the downstream nozzle group of each nozzle row 146 of the print head 144, respectively. In addition, the upstream nozzle group is physically different from the downstream nozzle group in the print position on the print medium. Therefore, when the raster data is transmitted from the raster buffer 132, the data position of the transmission start on the raster buffer is determined in consideration of the difference in the print position between the upstream nozzle group and the downstream nozzle group.

Alternatively, when it is determined that the printing order corresponds to the W-C printing (step S880: No), the CPU 110 transmits the raster data from the color image raster buffer 132*c* to the downstream head buffer 1421 (see FIG. 5) and simultaneously transmits the raster data from the toning white image raster buffer 132*w* to the upstream head buffer 142*u* (step S900). In this way, prepared is the W-C printing (see FIG. 22A) of forming the toning white image and the color image by using the upstream nozzle group and the downstream nozzle group of each nozzle row 146 of the print head 144, respectively.

Subsequently, the CPU 110 (see FIG. 3) controls the print medium feeding controller 160 and the print medium feeding motor 162 to feed the print medium PM up to the head position Y (execute the sub-scanning operation) (step S910) and also controls the CR controller 150 and the CR motor 152 to move the print head 144 up to the printing start position X (step S920). Then, the CPU 110 executes the printing corresponding to the height of the print head 144 by executing the main scanning operation (step S930). At this time, in the W-C printing (see FIG. 22A), the toning white image and the color image are concurrently formed by the upstream nozzle group and the downstream nozzle group (see FIG. 22C) of each nozzle row 146 of the print head 144, respectively. In the C-W printing (see FIG. 22B), the color image and the toning white image are concurrently formed by the upstream nozzle group and the downstream nozzle group of each nozzle row 146 of the print head 144, respectively.

Subsequently, the CPU 110 (see FIG. 3) clears the raster buffer pointer of the raster buffer 132 (step S940) and determines whether the printing is completed for the entire print image PI (step S950). Steps S810 to S940 are executed repeatedly until it is determined that the printing is completed.

When it is determined that the printing is completed in step S950, the CPU 110 (see FIG. 3) determines whether an unprinted image is still present (step S952). Specifically, the CPU 110 determines whether the printing on only the reverse side images (the first color image Ic1 and the first toning white image Iw1) is completed or the printing on both the reverse side images and the obverse side images (the second color image Ic2 and the second toning white image Iw2) is completed. When it is determined that the printing on only the reverse side images is completed and the printing on the obverse side images is not executed, the CPU 110 controls the rewind mechanism 190 to rewind the print medium (step S954) and again executes the process after step S810. When it is determined that the printing on both the reverse side images and the obverse side images is completed, the printing (see FIG. 6) ends.

As described above, the printing system 10 according to this embodiment can execute the printing of forming the reverse side images organized by the first color image Ic1 and the first toning white image Iw1 and the obverse side images organized by the second toning white image Iw2 and the second color image Ic2 on the transparent film TF as the print medium by using the plurality of color ink including the white ink. When the printing is executed by the printing system 10, the seven nozzle rows 146 corresponding to the seven ink colors and formed in the print head 144 of the printer 100 are divided into the upstream nozzle groups and the downstream nozzle groups (see FIG. 22C). When the reverse side images are printed, the toning white images are formed by ejecting the ink from the downstream nozzle groups by the C-W printing (see FIG. 22B). When the obverse side images are printed, the toning white images are formed by ejecting the ink from the upstream nozzle groups by the W-C printing (see FIG. 22A). Therefore, in either the printing on the reverse side images or the printing on the obverse side images, the toning white images (the first toning white image Iw1 and the second toning white image Iw2) can be formed using the white ink and at least one of the ink other than the white ink. Moreover, the color of the first toning white image Iw1 and the color of the second toning white image Iw2 can be set independently of each other. Accordingly, in the printing system 10 according to this embodiment, when the color image and the toning white image are printed using the plurality of color ink including the white ink, the toning white image can be printed with a desired color and the double-side print Pr can be expressed with diverse colors.

In particular, in the printing system 10 according to this embodiment, since the color of the toning white image can be automatically set in accordance with the color image, it is possible to easily set the color of the toning white image so as to match with the characteristics of the color image by intensifying the color image or increasing the contrast ratio of the color image, for example.

In the printing of the printing system 10 according to this embodiment, the toning white image can be formed using one of the upstream nozzle group and the downstream nozzle group in either of the printing on the obverse side images and the printing on the reverse side images. Moreover, since the color image can be formed using the other of the upstream nozzle group and the downstream nozzle group, the toning white image can be printed with a desired color even in a case where at least a part of the toning white image overlaps with the color image on the print medium.

In the printing of the printing system 10 according to this embodiment, the toning white image can be formed using one of the upstream nozzle group and the downstream nozzle group and the color image can be concurrently formed using the other of the upstream nozzle group and the downstream nozzle group upon executing the same main scanning operation (the same pass) in either the printing on the obverse side images and the printing on the reverse side images. Therefore, the color image and the toning white image can be effectively formed on the print medium. Moreover, the toning white image can be printed with a desired color.

In the printing system 10 according to this embodiment, the ink code contained in the raster command (see FIG. 18B) as a printing command is set so as to uniquely correspond to the combination of each of the seven ink colors and each of the color image and the toning white image. Therefore, the CPU 110 of the printer 100 can control the nozzle groups (the upstream nozzle groups or the downstream nozzle groups) used to form the color image on the basis of the raster command contained in the ink code corresponding to the color image without distinguishing the raster command for the color image from the raster command for the toning white image. Moreover, the CPU 110 can control the nozzle groups (the upstream nozzle groups or the downstream nozzle groups) used to form the toning white image on the basis of the raster command contained in the ink code corresponding to the toning white image.

In the printing system 10 according to this embodiment, the raster buffer 132 of the printer 100 has the color image area 132*c* and the toning white image area 132*w* (see FIG. 5). Therefore, the CPU 110 of the printer 100 can control the nozzle group used to form the color image and the nozzle group used to form the toning white image by allowing the raster buffer 132 to store the raster data contained in the raster command containing the ink code corresponding to the color image in the color image area 132*c* and by allowing the raster buffer 132 to store the raster data contained in the raster command containing the ink code corresponding to the toning white image in the toning white image area 132*w*.

In the printing of the printing system 10 according to this embodiment, four color kinds of ink such as yellow (Y) ink, black (K) ink, light cyan (Lc) ink, and light magenta (Lm) ink are used among the six color kinds of ink other than white ink to form the toning white image. Two color kinds of ink, that is, the cyan (C) ink and the magenta (M) ink are not used. That is, between the two kinds of ink, that is, the light color ink and the dark color ink for the same color ink the dark ink is not used for the formation of the toning white image. Therefore, in the printing according to this embodiment, the image quality of the toning white image can be suppressed from deteriorating (increasing granularity). In the printing according to this embodiment, since the black (K) ink is used to form the toning white image, the brightness of the toning white image can be adjusted and thus the color selection range of the toning white image can be expanded.

B. Modified Examples

The invention is not limited to the above-described embodiment, but may be modified in various forms without departing from the gist of the invention. For example, the following modified examples can be realized.

B1. Modified Example 1

In the above-described embodiment, the printer 100 includes the rewind mechanism 190. However, the printer 100 may not include the rewind mechanism 190. In the above-described embodiment, the generation of the double-side print Pr is realized, that is, the generation of the first color image Ic1, the first toning white image Iw1, the second toning white image Iw2, and the second color image Ic2 on the transparent film TF as the print medium in this order is realized using the rewind mechanism 190 of the printer 100. However, the double-side print Pr may be realized in accordance with another method. When the printer 100 does not include the rewind mechanism 190, the generation of the double-side print Pr can be realized by dividing the nozzle rows 146 of the print head 144 of the printer 100 into four nozzle groups, forming the first color image Ic1 by the nozzle group located on the uppermost upstream side, forming the first toning white image Iw1 by the second nozzle group located on the upstream side, forming the second toning white image Iw2 by the third nozzle group located on the upstream side, and forming the second color image Ic2 by the nozzle group located on the lowermost downstream side. In this case, the first and fourth nozzle groups located on the upstream side correspond to the first nozzle group, and the second and third nozzle groups located on the upstream side correspond to the second nozzle group according to the embodiment of the invention.

B2. Modified Example 2

In the above-described embodiment, when the toning white color is designated automatically (step S334 of FIG. 10), the color of the toning white is set depending on the color image, but the color of the toning white may be set automatically by another method. For example, the color of the toning white may be set automatically depending on whether the toning white image Iw is the reverse side image (see FIGS. 7A and 7B) or the obverse side image. Since the first toning white image Iw1 as the reverse side image is observed easily through the transparent film TF, an image with a shiny impression is readily obtained. On the other hand, since the second toning white image Iw2 as the obverse side image is directly observed, an image with a mat impression is readily obtained. That is, the reverse side image and the obverse side image are different in the impression (texture) of the observed image. For example, the color of the first toning white image Iw1 may be set to a toning white having a strong tinge and the color of the second toning white image Iw2 may be set to a toning white having a slight tinge. On the contrary, the color of the first toning white image Iw1 may be set to a toning white having a slight tinge and the color of the second toning white image Iw2 may be set to a toning white having a strong tinge. In this way, even when the color of the toning white is set automatically depending on whether the toning white is the reverse side image or the obverse side image, the color of the toning white may be set to a desired color. Moreover, the double-side print Pr can be expressed with diverse colors.

B3. Modified Example 3

In the above-described embodiment, the configuration of the printing system 10 is just an example. The configuration of the printing system 10 may be modified in various forms. For example, in the above-described embodiment, the printer 100 executes the printing using the ink of seven colors, that is, cyan, magenta, yellow, black, light cyan, light magenta, and white. However, the printer 100 may be a printer that executes the printing using the plurality of color ink including white ink. For example, the printer 100 may be a printer that executes printing using ink of five colors such as cyan, magenta, yellow, black, and white.

In the above-described embodiment, when the color image is formed, the ink of the six colors other than the white is used and the white ink is not used. However, the ink color used when the color image is formed may be set arbitrarily depending on the ink color usable in the printer 100. For example, when the color image is formed, white ink may be used.

In the above-described embodiment, for the formation of the toning white image, the ink of the five colors, that is, white, yellow, black, light cyan, and light magenta is used and the ink of the two colors, that is, cyan and magenta are not used. However, as long as the ink colors used when the toning white image is formed may include white and at least one color other than white, the ink colors may be set arbitrarily depending on the ink colors usable in the printer 100. For example, for the formation of the toning white image, only ink of four colors such as white, yellow, light cyan, and light magenta may be used. Alternatively, ink of seven colors such as white, yellow, black, light cyan, light magenta, cyan, and magenta may be used.

In the above-described embodiment, the printer 100 is a printer that executes the printing while reciprocating (main scanning operation) the carriage mounting the print head 144. However, the embodiment of the invention is applicable to printing executed by a line printer in which the carriage does not reciprocate.

In the above-described embodiment, the printer driver 300 is included in the PC 200 and the printer 100 receives the command from the printer driver 300 of the PC 200 to execute the printing (see FIG. 4). However, the printer 100 may include the same function as that of the printer driver 300 and the printer 100 may receive the color image data Cdata, the white image data WIdata, and the image order designation information SS from the application program AP of the PC 200 to execute the printing. Alternatively, the printer 100 may further include the same function as that of the application program AP and the printer 100 may generate the color image data Cdata, the white image data WIdata, and the image order designation information SS and may execute the printing.

In the above-described embodiment, the details of the lookup table LUT are just an example. For example, the details of the lookup table LUT may be set experimentally in accordance with the combinations of ink used in the printer 100. The details of the lookup table LUT may be modified in various forms in accordance with the details (usable color space) of data output from the application program AP or the ink colors used in the printer 100. Similarly, the details of the color conversion process or the ink color division process using this table may be modified in various forms.

In the above-described embodiment, the halftone process module 320 (see FIG. 4) executes the halftone process with reference to the dither pattern. However, the halftone process may be executed in accordance with another method such as an error diffusion method. When the printer 100 can form dots of plural sizes for each ink color, the binarization may not be executed to determine ON/OFF of the dot, but a multi-valued operation may be executed to determine ON/OFF of the dot and the size of the dot.

In the above-described embodiment, the structure of the printing order designation command or the raster command according to this embodiment is just an example. The structure of the printing order designation command or the raster command may be modified in various forms. In the above-described embodiment, the ink code uniquely corresponds to the combination of each of the plural ink colors and each of the color images and the toning white images. However, the ink code may not be set necessarily in this way. When the ink code is set in this way, the CPU 110 of the printer 100 may process the command in accordance with the ink code contained in the raster command without distinguishing the raster command for the color image from the raster command for the toning white image.

In the above-described embodiment, a part of the configuration realized by hardware may be realized by software. On the contrary, a part of the configuration realized by software may be realized by hardware.

When some or all of the functions according to the embodiment of the invention are realized by software, the software may be provided in the form stored in a computer readable recording medium. The "computer readable printing medium" in the embodiment of the invention is not limited to a portable recording medium such as a flexible disk or a CD-ROM, but may include an internal memory device, such as various kinds of RAM or ROM, in a computer and an external memory device, such as a hard disk drive, fixed to a computer.

In the above-described embodiment, the printer 100 can execute the printing of forming only the color image (including a color image formed with white ink). In this case, the printing is executed using all of the nozzle rows 146 without dividing each nozzle row 146 (see FIGS. 22A to 22C) of the print head 144 into the upstream side and the downstream side. That is, the printing may be executed by dividing each nozzle row 146 into the nozzle group used to form the color image and the nozzle group used to form the toning white image, only when the printer 100 executes the printing of forming the color image and the toning white image.

In the above-described embodiment, the displayed details of the UI window W1 for the toning white designation and the UI window W2 for the color measurement according to the embodiment are just examples, and these displayed details may be modified in various forms. For example, in the UI window W1 for the toning white designation according to the above-described embodiment, the toning white is designated by the L*a*b* table color system. However, the toning white may be designated by another table color system (for example, an L*u*v* table color system). In the UI window W1 for the toning white designation according to the above-described embodiment, the density of the toning white is designated by the T value. However, the designation of the T value may be omitted. In the UI window W1 for the toning white designation according to the above-described embodiment, the toning white can be designated by the color measurement (see the UI window W2 for the color measurement). However, the toning white may not be designated by the color measurement.

What is claimed is:

1. A printing apparatus which executes printing on a transparent print medium using a plurality of color ink including white ink, comprising:

a first nozzle group configured to eject the plurality of color ink to form a color image;

a second nozzle group configured to eject the white ink and at least one color ink other than the white ink to form a toning white image, which is an adjusted white image; and a controller configured to control printing such that printing forms a first color image on the transparent print medium, forms a first toning white image on the first color image, forms a second toning white image on the first toning white image, and forms a second color image on the second toning white image;

wherein, the controller is configured to control printing such that a color of the first toning white image viewed from one side of the transparent print medium differs from a color of the second toning white image viewed from an opposite side of the transparent print medium.

2. The printing apparatus according to claim 1, wherein the controller is further configured to set the color of the first toning white image on the basis of the first color image and sets the color of the second toning white image on the basis of the second color image.

3. The printing apparatus according to claim 2, wherein the controller is further configured to control printing such that the color of the first toning white image includes a complementary color of the first image.

4. The printing apparatus according to claim 2, wherein the controller is further configured to control printing such that the color of the second toning white image includes a complementary color of the second image.

5. The printing apparatus according to claim 1, further comprising:

a rewind mechanism rewinding the transparent print medium on which an image is formed, wherein the controller is configured to control the rewind mechanism such that the transparent print medium is rewound after the first color image and the first toning white image are formed on the transparent print medium and controls printing to form the second toning white image and the second color image on the rewound transparent print medium.

6. The printing apparatus according to claim 5, wherein the controller is further configured to control the rewind mechanism such that a positional relationship of the first and second nozzle groups is reversed between when forming the first color image and the first toning white image on the transparent print medium and when forming the second color image and the second toning white image on the transparent print medium, and wherein the controller is further configured to control the head so as to concurrently form the first color image by the first nozzle group and form the first toning white image by the second nozzle group for at least a part of a printing period and so as to concurrently form the second toning white image by the second nozzle group and the second color image by the first nozzle group for at least another part of the printing period.

7. The printing apparatus according to claim 1, wherein each of the first and second nozzle groups include two sub-nozzle groups, and wherein the controller is further configured to control the head so as to concurrently form the first color image by one of the sub-nozzle groups of the first nozzle group, form the first toning white image by one of the sub-nozzle groups of the second nozzle group, form the second toning white image by the other of the sub-nozzle groups of the second nozzle group, and form the second color image by the other of the sub-nozzle groups of the first nozzle group for at least a part of a printing period.

8. The printing apparatus according to claim 1, wherein the controller is further configured to form the first toning white image and the second toning white image in the same area of the surface of the transparent print medium.

9. The printing apparatus according to claim 1, wherein the plurality of color ink includes a combination of light color ink and dark color ink for at least one color ink, and wherein the controller is configured such that the second nozzle group does not eject the dark color ink.

10. The printing apparatus according to claim 1, wherein the controller is further configured to control printing such that an amount of color ink other than the white ink used in printing the first toning white image is larger than an amount of the one color ink used in printing the second toning white image.

11. The printing apparatus according to claim 1, wherein the controller is further configured to control printing such that an amount of color ink other than the white ink used in the second toning white image is larger than an amount of the one color ink used in printing the first toning white image.

12. A printing system comprising:

a printing apparatus executing printing on a transparent print medium using a plurality of color ink including white ink; and a print control apparatus controlling the printing executed by the printing apparatus, wherein the printing apparatus includes a first nozzle group ejecting the plurality of color ink to form a color image and a second nozzle group ejecting the white ink and at least one color ink other than the white ink to form a toning white image, which is an adjusted white image, and wherein the print control apparatus is configured to control printing such that printing forms a first color image on the transparent print medium, forms a first toning white image on the first color image, forms a second toning white image on the first toning white image, and forms a second color image on the second toning white image;

wherein, the print control apparatus configured to control printing such that a color of the first toning white image viewed from one side of the transparent print medium differs from a color of the second toning white image viewed from an opposite side of the transparent print medium.

* * * * *